US009384724B2

(12) United States Patent
Dejima

(10) Patent No.: US 9,384,724 B2
(45) Date of Patent: Jul. 5, 2016

(54) MUSIC PLAYING DEVICE, ELECTRONIC INSTRUMENT, MUSIC PLAYING METHOD, AND STORAGE MEDIUM

(71) Applicant: CASIO COMPUTER CO., LTD., Tokyo (JP)

(72) Inventor: Tatsuya Dejima, Tokyo (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 14/297,198

(22) Filed: Jun. 5, 2014

(65) Prior Publication Data

US 2014/0360341 A1 Dec. 11, 2014

(30) Foreign Application Priority Data

Jun. 10, 2013 (JP) ..... 2013-122088

(51) Int. Cl.

| | |
|---|---|
| ***G10H 1/18*** | (2006.01) |
| ***G10H 7/00*** | (2006.01) |
| ***G10H 1/34*** | (2006.01) |
| *G10H 3/12* | (2006.01) |

(52) U.S. Cl.
CPC ..... *G10H 7/002* (2013.01); *G10H 1/342* (2013.01); *G10H 3/125* (2013.01)

(58) Field of Classification Search
CPC ..... G10H 7/002; G10H 1/342; G10H 3/125
USPC ..... 84/722, 742
See application file for complete search history.

(56) References Cited

U.S. PATENT DOCUMENTS

| | | | | | |
|---|---|---|---|---|---|
| 4,748,887 | A | * | 6/1988 | Marshall | 84/646 |
| 4,841,827 | A | * | 6/1989 | Uchiyama | 84/622 |
| 4,919,031 | A | * | 4/1990 | Matsumoto | 84/601 |
| 5,018,428 | A | | 5/1991 | Uchiyama et al. | |
| 5,025,703 | A | * | 6/1991 | Iba et al. | 84/718 |
| 5,040,447 | A | * | 8/1991 | Murata et al. | 84/612 |
| 5,153,364 | A | | 10/1992 | Uchiyama et al. | |
| 2008/0236374 | A1 | | 10/2008 | Kramer et al. | |

FOREIGN PATENT DOCUMENTS

| | | | |
|---|---|---|---|
| EP | 0 749 107 | A2 | 12/1996 |
| JP | S63-136088 | A | 6/1988 |

OTHER PUBLICATIONS

European Search Report dated Oct. 29, 2014, in a counterpart European patent application No. 14171756.1.
European Office Action dated Jan. 28, 2016, in a counterpart European patent application No. 14171756.1.

* cited by examiner

*Primary Examiner* — Jeffrey Donels
(74) *Attorney, Agent, or Firm* — Chen Yoshimura LLP

(57) ABSTRACT

A CPU detects an operation state on a fingerboard at a prescribed period, stores the detected operation state in a memory every time an operation state is detected, detects whether or not any of a plurality of extended strings has been struck, determines a pitch of a note to be played based on the operation state stored in the memory in response to a string being struck, and controls a note to be played in a sound source based on the detected operation state and the operation state stored in the memory every time the operation state is detected after a command to play a note of a determined pitch is issued to the sound source.

9 Claims, 23 Drawing Sheets

| Type | Change from Previous | | | Finger Movement |
|---|---|---|---|---|
| | $S_F$ | $S_M$ | $S_N$ | |
| (1) | ↗ | → | ↗ | Pitch: shifted upward |
| (2) | ↗ | → | ↘ | Pitch: shifted downward |
| (3) | ↗ | → ↗ | ↗ | Increase in number of fingers pressing string |
| (4) | ↘ | ↘ | ↘ | Decrease in pressure on string |
| (5) | → | → | → | Other pattern |

FIG. 21A

MUSIC PLAYING DEVICE, ELECTRONIC INSTRUMENT, MUSIC PLAYING METHOD, AND STORAGE MEDIUM

This application claims the benefit of Japanese Application No. 2013-122088, filed in Japan on Jun. 10, 2013, which is hereby incorporated by reference in its entirety.

BACKGROUND OF THE INVENTION

Field of the Invention

The present invention relates to a music playing device, an electronic instrument, a music playing method, and a storage medium.

Conventional input control devices that extract the pitch of an inputted waveform signal and issue a command to play a musical note corresponding to this extracted pitch are known. As this type of device, Japanese Patent Application Laid-Open Publication No. S63-136088 discloses a technique of detecting a zero-crossing period of a waveform immediately after the maximum value of an inputted waveform signal is detected and a zero-crossing period of a waveform immediately after the minimum value of the inputted waveform signal is detected, and then issuing a command to play a musical note of a pitch corresponding to a period detected when the two periods substantially match, or a technique in which the maximum value detection period and a minimum value detection period of an inputted waveform signal are detected, and a command is issued to play a musical note of a pitch corresponding to the periods detected when the two periods substantially match played, for example.

However, with this method, the degree to which the string is pressed by a left hand is not detected. In a real guitar, there are multiple degrees to which the left hand presses the strings.

For example, if the string is pressed so as to lightly touch a fret, then the string vibrates at the correct pitch. If the string is pressed harder, then the string greatly bends towards the fingerboard along with the finger, which increases the tension of the string, thus slightly raising the pitch. Performers typically use this mechanism in order to achieve vibrato.

Also, in fretless instruments (such as fretless guitars), the position of the finger pressing the string is shifted over the fingerboard along the string, thereby achieving vibrato or changing the pitch.

Performers control the degree to which the left hand presses the string in order to subtly control the tone, but in the conventional method, the degree to which the left hand presses the strings was not detected, and thus, there was no mechanism by which to reproduce this type of sound, which meant that it was not possible to reproduce the subtle changes in tone and pitch based on the degree to which the strings are pressed.

SUMMARY OF THE INVENTION

The present invention takes into account this situation, and an object thereof is to provide a music playing device, an electronic instrument, a music playing method, and a storage medium by which it is possible to reproduce subtle changes in tone and pitch based on the degree to which the string is pressed.

Additional or separate features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, in one aspect, the present invention provides a music playing device, including: a pitch operation receiver that electrically and continuously monitors and receives a pitch determination operation by a user; sound commencement operation receiver that electrically receives a sound commencement operation by the user; and a controllable sound source connected to the pitch operation receiver and to the sound commencement operation receiver, the controllable sound source emitting a sound at a time of the sound commencement operation receiver receiving the sound commencement operation by the user at an initial pitch determined by a pitch determination operation that is received by the pitch operation receiver when the sound commencement operation receiver receives the sound commencement operation by the user, the controllable sound sources continuously emitting the sound until a prescribed time is passed or until the user causes the sound commencement operation receiver to receive another sound commencement operation time, whichever occurs first, wherein the controllable sound source modulates the sound during emission thereof based on a subsequent pitch determination operation of the user received by the pitch operation receiver subsequent to reception of the pitch determination operation that determined the initial pitch.

In the above-described aspect, the pitch operation receiver may include: an operation unit; an operation detection unit connected to the operation unit, the operation detection unit detecting an operation state for an operation performed by a user on the operation unit; and a memory control unit that stores the detected operation state in a memory as a current operation state and that designates as an immediately previous operation state an operation state stored in the memory immediately prior to the current operation state being stored, every time the operation state is detected. Further, the sound commencement operation receiver may include a play command operation detection unit that detects a play command operation performed by the user. Also, the controllable sound source may include: a pitch determination unit that determines a pitch of a musical note to be played in response to the play command operation being detected and based on the current operation state stored in the memory; a play command unit that issues a command to a sound source to play the musical note of the determined pitch; and a first musical note control unit that, after the command to play the musical note is issued to the sound source, modulates the musical note played in the sound source based on the current operation state and the immediately previous operation state stored in the memory.

In another aspect, the present invention provides a music playing device that includes: an operation detection unit configured to be connected to an operation unit, the operation detection unit detecting an operation state for an operation performed by a user on the operation unit; a memory control unit that stores the detected operation state in a memory as a current operation state and that designates as an immediately previous operation state an operation state stored in the memory immediately prior to the current operation state being stored, every time the operation state is detected; a play command operation detection unit that detects a play command operation performed by the user; a pitch determination unit that determines a pitch of a musical note to be played in response to the play command operation being detected and based on the current operation state stored in the memory; a play command unit that issues a command to a sound source to play the musical note of the determined pitch; and a first musical note control unit that, after the command to play the musical note is issued to the sound source, controls the musical note played in the sound source based on the current operation state and the immediately previous operation state stored in the memory.

In another aspect, the present invention provides an electronic instrument that includes: the above-mentioned music playing device; the operation unit; and a sound source that generates the musical note in response to a command to play a sound from a music play command unit.

In another aspect, the present invention provides a music playing method performed in a music playing device, the method including: detecting an operation state for an operation performed by a user on an operation unit; storing the detected operation state in a memory as a current operation state and designating as an immediately previous operation state an operation state stored in the memory immediately prior to the current operation state being stored, every time the operation state is detected; detecting a play command operation performed by the user to issue a command to play a sound; determining a pitch of a musical note to be played in response to the play command operation being detected and based on the current operation state stored in the memory; issuing a command to a sound source to play the musical note of the determined pitch; and controlling, after the command to play the musical note is issued to the sound source, the musical note played in the sound source based on the current operation state and the immediately previous operation state stored in the memory.

In another aspect, the present invention provides a non-transitory storage medium that can be read by a computer provided in a music playing device, the non-transitory storage medium storing a computer program to be executed by the computer to cause the music playing device having the computer to perform the following steps: detecting an operation state for an operation performed by a user on an operation unit; storing the detected operation state in a memory as a current operation state and designating as an immediately previous operation state an operation state stored in the memory immediately prior to the current operation state being stored, every time the operation state is detected; detecting a play command operation performed by the user to issue a command to play a sound; determining a pitch of a musical note to be played in response to the play command operation being detected, and based on the current operation state stored in the memory; issuing a command to a sound source to play the musical note of the determined pitch; and controlling, after the command to play the musical note is issued to the sound source, the musical note played in the connected sound source based on the current operation state and the immediately previous operation state stored in the memory.

It is to be understood that both the foregoing general description and the following detailed description are exemplary and explanatory, and are intended to provide further explanation of the invention as claimed.

BRIEF DESCRIPTION OF THE DRAWINGS

FIGS. 21A and 21B are for calculating the amount of change in frequency from when the string is initially played.

DETAILED DESCRIPTION OF THE PREFERRED EMBODIMENTS

Below, an embodiment of the present invention will be explained with reference to drawings.

<Summary of Electronic String Instrument>

Figure 1:
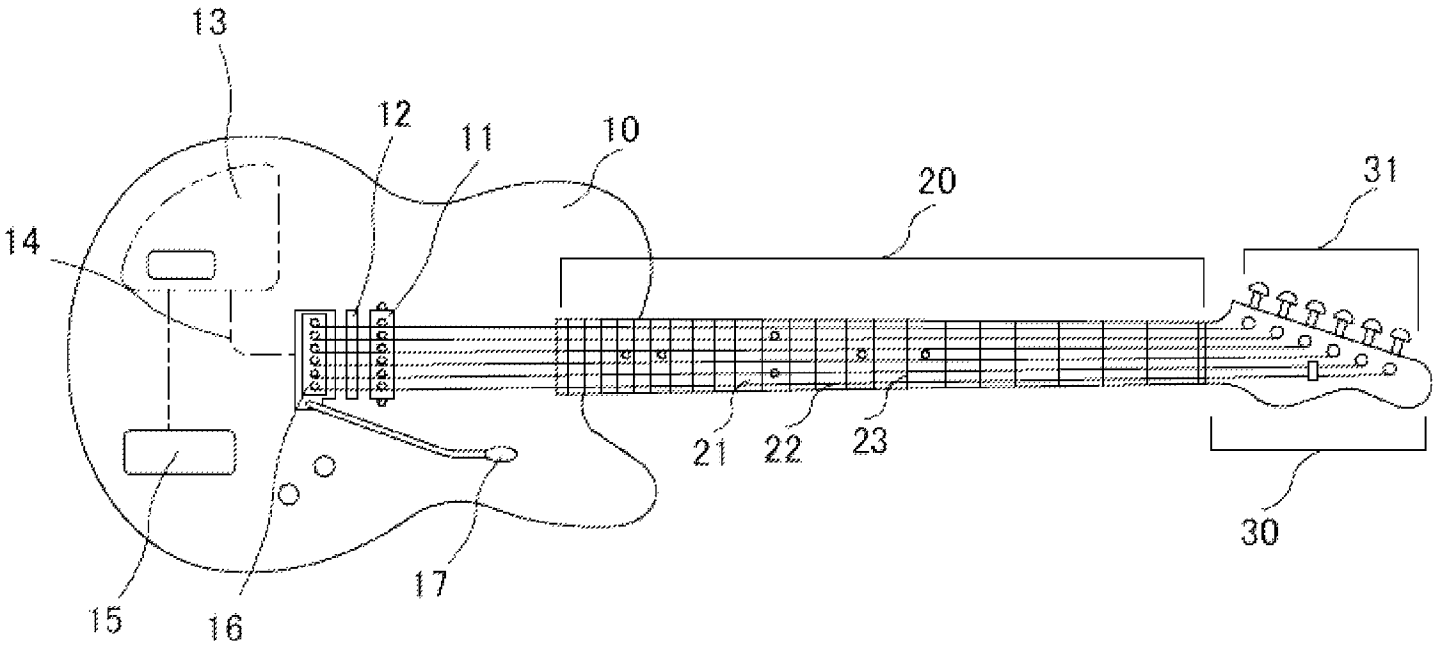
FIG. 1 is a front view showing an outer appearance of an electronic string instrument of the present invention.

First, an electronic string instrument 1 will be summarized as one embodiment of the present invention with reference to FIG. 1.

FIG. 1 is a front view showing an outer appearance of the electronic string instrument 1. As shown in FIG. 1, the electronic string instrument 1 is mainly constituted of a main body 10, a neck 20, and a headstock 30.

The headstock 30 has attached thereto tuning pegs 31 around which one end of steel strings 22 are respectively wound, and in the neck 20, a plurality of frets 23 are embedded in a fingerboard 21. In the present embodiment, there are six strings 22, and 22 frets 23. The six strings 22 respectively have string numbers assigned thereto. The thinnest string 22 is a "first" string, and the string number increases in order of thickness of the strings 22. The 22 frets 23 respectively have fret numbers assigned thereto. The fret 23 closest to the headstock 30 is a "first" fret, and the number of the fret 23 is greater, the further away it is from the headstock 30.

The main body 10 includes: a bridge 16 to which another end of the strings 22 is attached, a normal pickup 11 that detects vibration in the strings 22, hexaphonic pickups 12 that respectively detect the vibrations of the individual strings 22 independent of each other, a tremolo arm 17 for adding a tremolo effect on the outputted sound, an electronic unit 13 installed inside the main body 10, a cable 14 connecting the respective strings 22 to the electronic unit 13, and a display portion 15 for displaying the type of tone and the like.

Figure 2:
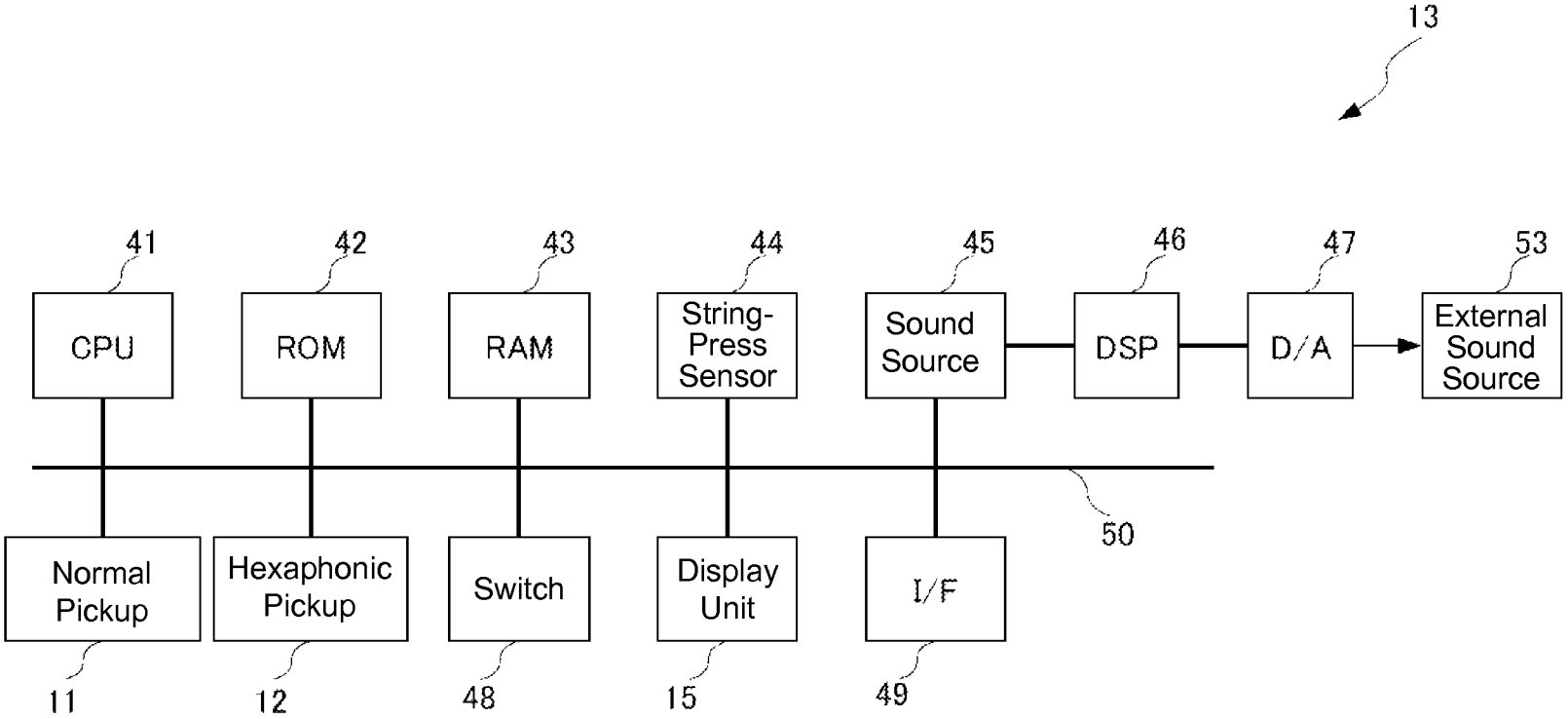
FIG. 2 is a block diagram showing a hardware configuration of an electronic unit included in the electronic string instrument.

FIG. 2 is a block diagram for showing the hardware configuration of the electronic unit 13. The electronic unit 13 includes a CPU 41 (central processing unit), ROM 42 (read only memory), RAM 43 (random access memory), a string press sensor 44, a sound source 45, a normal pickup 11, hexaphonic pickups 12, a switch 48, a display unit 15, and an interface (UF) 49, which are connected to each other through a bus 50.

The electronic 13 additionally includes a DSP 46 (digital signal processor), and a D/A 47 (digital/analog converter).

The CPU 41 executes various processes according to programs stored in the ROM 42 or programs loaded into the RAM 43 from a storage unit (not shown).

The RAM 43 appropriately stores data and the like necessary for the CPU 41 to execute various processes.

The string-press sensor 44 detects what number string is pressed at what number fret. The string-press sensor 44 detects whether a string 22 (refer to FIG. 1) has been pressed on any of the frets 23 (refer to FIG. 1) based on output from an electrostatic sensor to be described later.

The sound source 45 generates waveform data for a musical note for which a play command has been issued from MIDI (musical instrument digital interface) data, for example, performs a D/A conversion on this waveform data to obtain an audio signal, and outputs this audio signal to an external sound source 53 through the DSP 46 and the D/A 47, thus outputting a command to play a sound or fade out a sound. The external sound source 53 includes an amplifier circuit (not shown) that amplifies the audio signal outputted from the D/A 47 and outputs the signal, and a speaker (not shown) that outputs a musical note based on this audio signal inputted from the amplifier circuit.

The normal pickup 11 converts a detected vibration of the strings 22 (refer to FIG. 1) to an electric signal and outputs this signal to the CPU 41.

The hexaphonic pickups 12 convert the detected vibration of each individual string 22 (refer to FIG. 1) independently to an electric signal, and outputs the signal to the CPU 41.

The switch 48 outputs to the CPU 41 input signals from various switches (not shown) provided in the main body 10 (refer to FIG. 1).

The display unit 15 displays various tones to be played.

Figure 3:
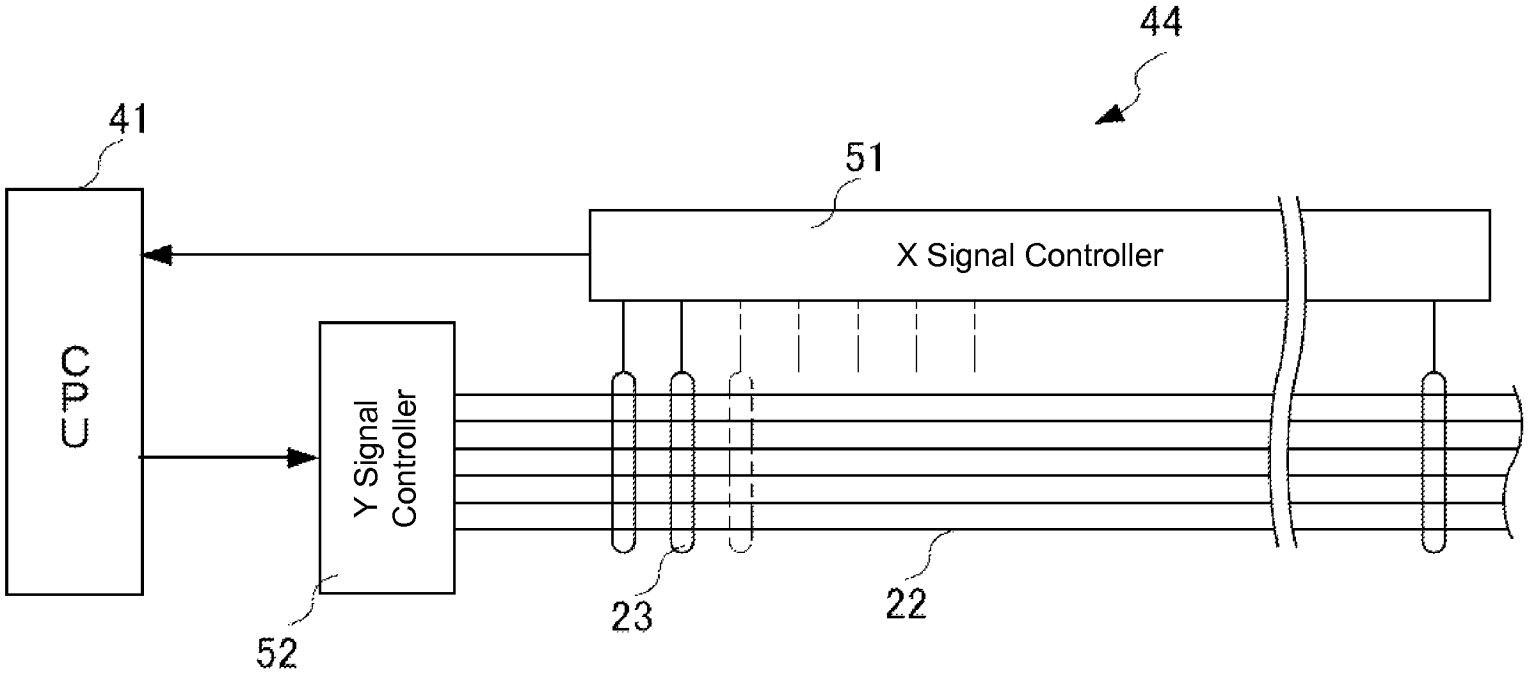
FIG. 3 is a schematic view showing a signal controller of a string-press sensor.

FIG. 3 is a schematic view showing a signal controller of the string-press sensor 44.

In the string-press sensor 44, a Y signal controller 52 sequentially selects any one of the strings 22 and selects the electrostatic sensors corresponding to the selected string. The X signal controller 51 selects any one of the frets 23 and selects the electrostatic sensors corresponding to the selected fret. By doing so, only the simultaneously selected electrostatic sensors of the string 22 and fret 23 are operated, and changes in output values of the operating electrostatic sensors are outputted as string-press position information to the CPU 41 (see FIG. 2).

Figure 4:
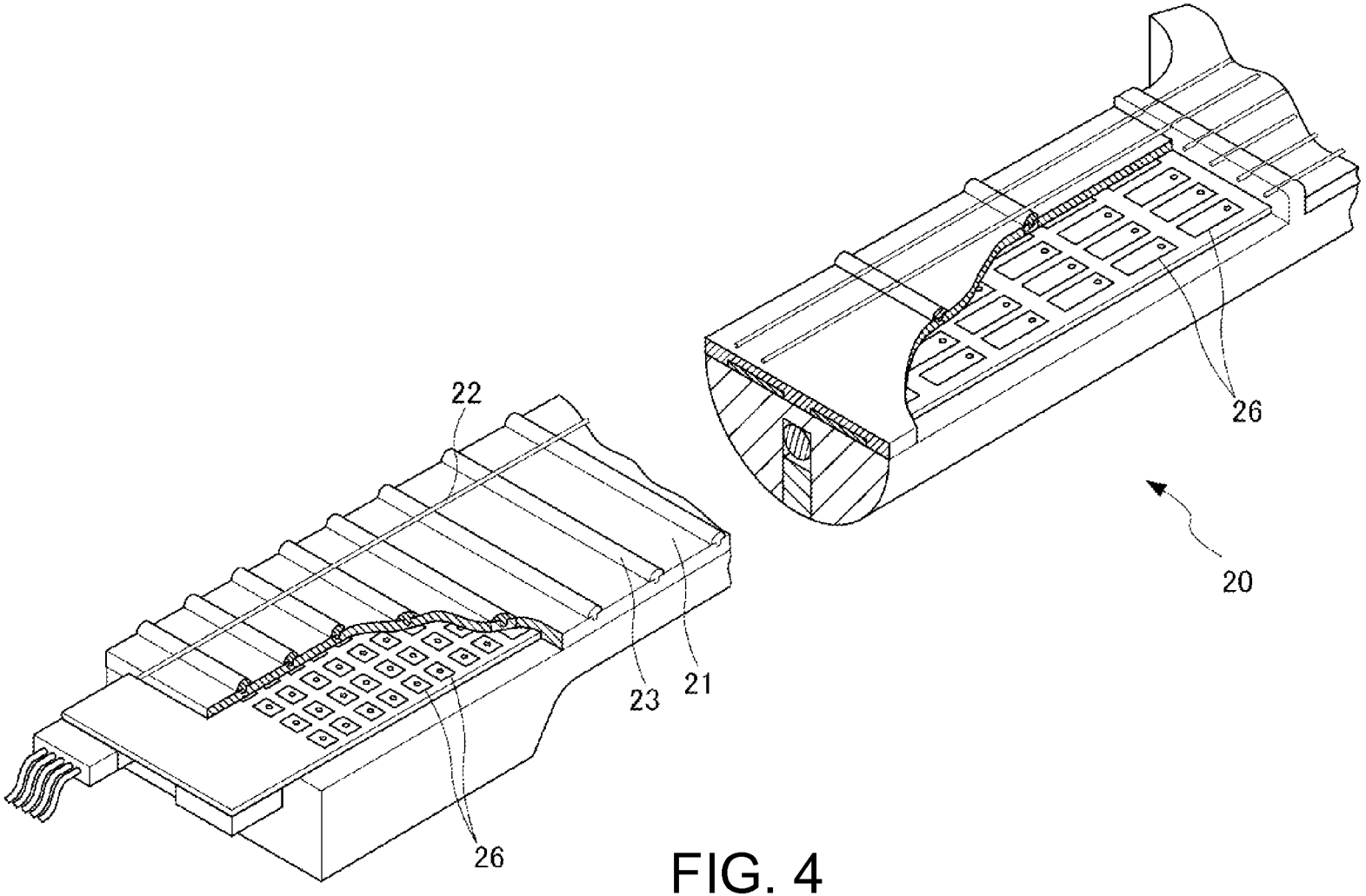
FIG. 4 is a perspective view of a neck having a string-press sensor that detects the degree to which a string is pressed, with contact between string and fret not being detected based on output from an electrostatic sensor.

FIG. 4 is a perspective view of the neck 20 in which string-press sensors 44 that detect that a string is being pressed are used without detecting contact between the string 22 and the fret 23 based on the output from the electrostatic sensors.

In FIG. 4, below the fingerboard 21, a set of electrostatic pads 26 as electrostatic sensors are positioned for each of the strings 22 and each of the frets 23. In other words, if there are six strings and 22 frets as in the present embodiment with two electrostatic pads per space between frets for each string, there are a total of 264 electrostatic pads. These electrostatic pads 26 detect capacitance when a string 22 comes close to the fingerboard 21 and sends this to the CPU 41. The CPU 41 detects the string 22 and the fret 23 at the position where the string is pressed based on the value of the capacitance sent to the CPU 41.

<Main Flow>

Figure 5:
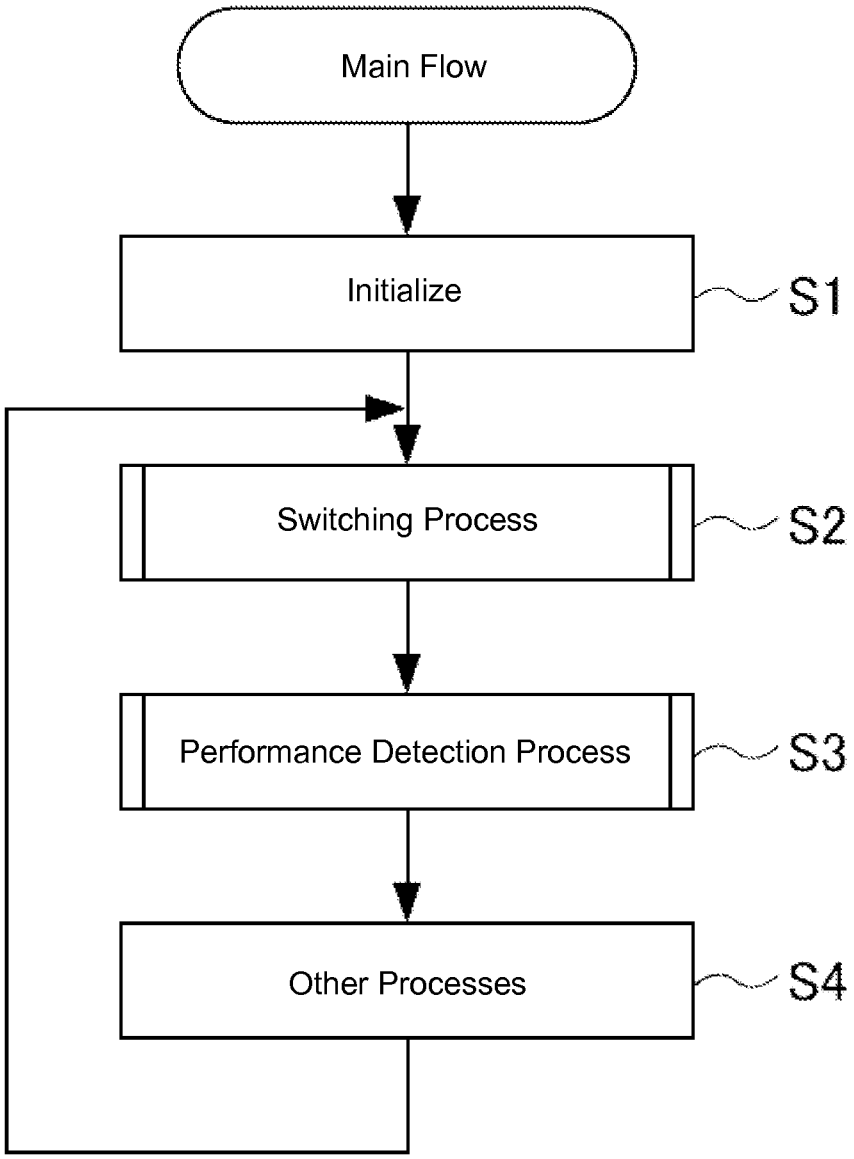
FIG. 5 is a flow chart showing a main flow of steps executed in an electronic string instrument of the present embodiment.

FIG. 5 is a flow chart showing a main flow of steps executed in an electronic string instrument 1 of the present embodiment.

First, in step S1, the CPU 41 performs initialization when powered on. In step S2, the CPU 41 performs a switching process (described later in FIG. 6). In step S3, the CPU 41 performs performance detection (described later in FIG. 8). In step S4, the CPU 41 performs other processes. In the other processes, the CPU 41 performs processes such as displaying the code name of an output code in the display unit 15, for example. After step S4 is completed, the CPU 41 returns to step S2 and repeats the processes of steps S2 to S4.

<Switching Process>

Figure 6:
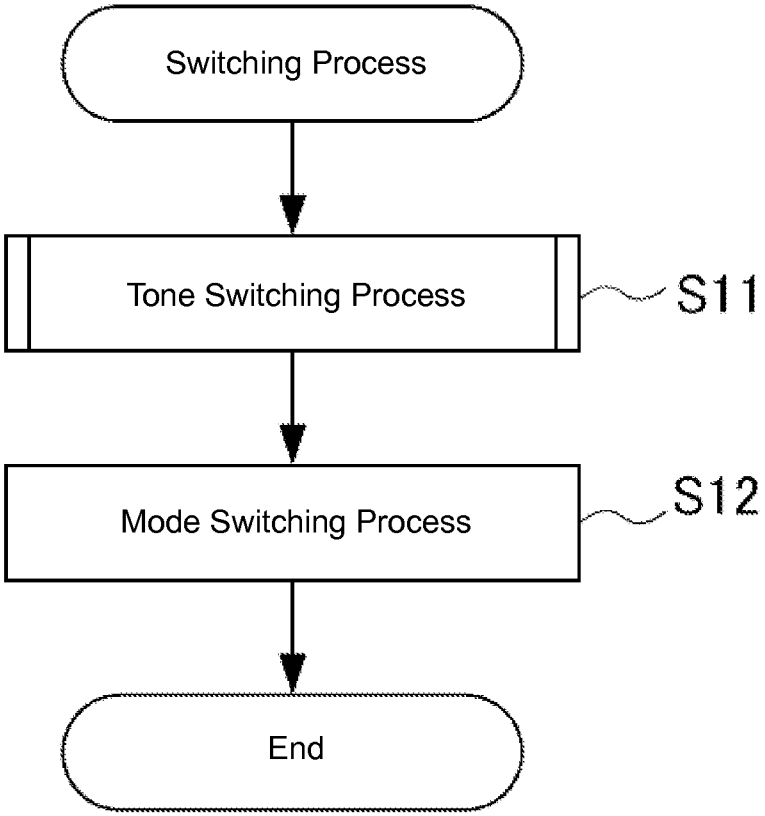
FIG. 6 is a flow chart showing a switching process executed in an electronic string instrument of the present embodiment.

FIG. 6 is a flow chart showing a switching process executed in the electronic string instrument 1 of the present embodiment.

First, in step S11, the CPU 41 performs a tone switching process (described later in FIG. 7). In step S12, the CPU 41 performs a mode switching process. In the mode switching process, the CPU 41 determines a mode for determining whether or not a parameter changing process (to be described later in FIG. 17) has been performed. After step S12 is completed, the CPU 41 ends switching process.

<Tone Switching Process>

Figure 7:
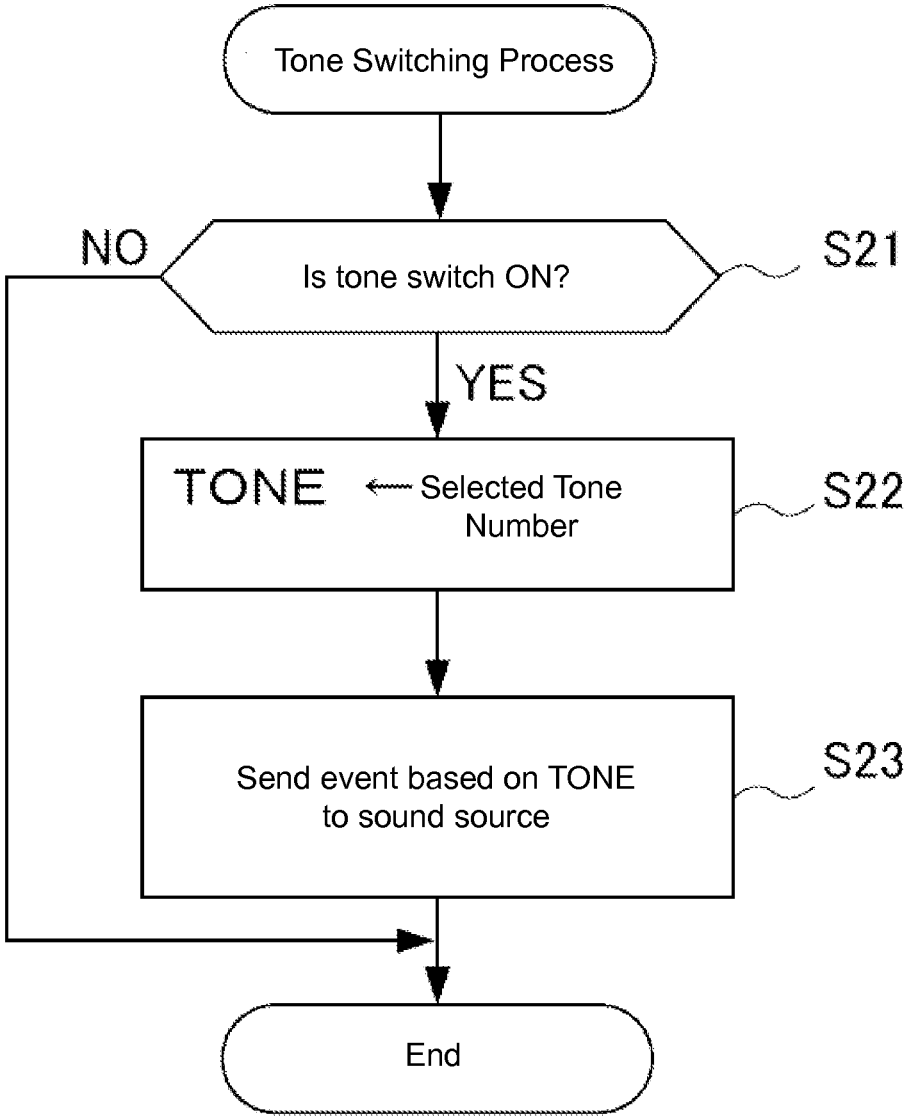
FIG. 7 is a flow chart showing a tone switching process executed in an electronic string instrument of the present embodiment.

FIG. 7 is a flow chart showing a tone switching process executed in the electronic string instrument 1 of the present embodiment.

First, in step S21, the CPU 41 determines whether or not a tone switch (not shown) is on. If it is determined that the tone switch is on, the CPU 41 moves to step S22, and if it is determined that the tone switch is off, the CPU 41 ends the tone switching process. In step S22, the CPU 41 stores a tone number corresponding to the tone selected by the tone switch in a variable TONE. In step S23, the CPU 41 sends an event based on the variable TONE to the sound source 45. As a result, a tone to be played is set in the sound source 45. After step S23 is completed, the CPU 41 performs a tone switching process.

<Performance Detection Process>

Figure 8:
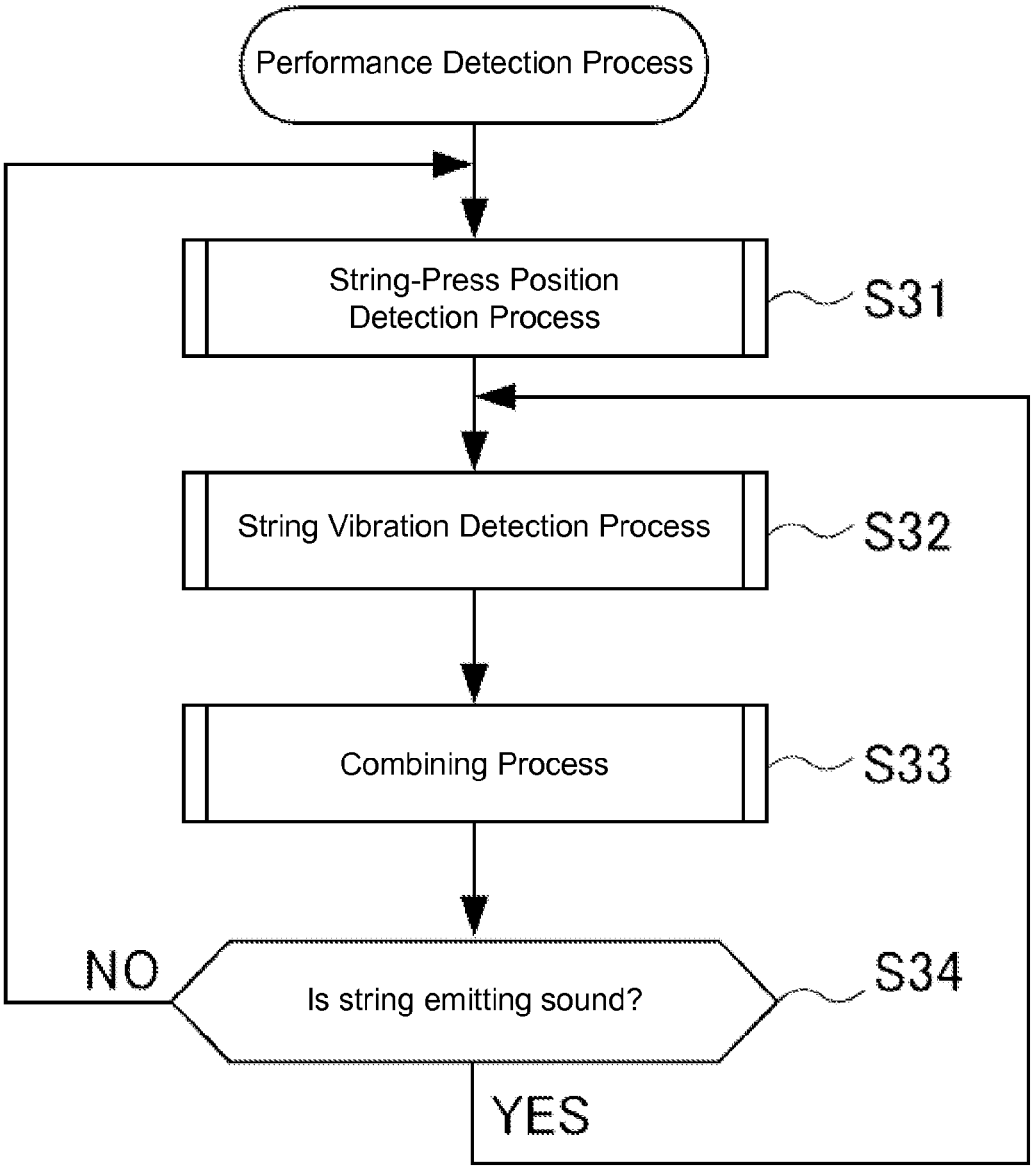
FIG. 8 is a flow chart showing a play detection process executed in an electronic string instrument of the present embodiment.

FIG. 8 is a flow chart showing a performance detection process executed in the electronic string instrument 1 of the present embodiment.

First, in step S31, the CPU 41 performs a string-press position detection process (described later in FIG. 9). In step S32, the CPU 41 performs a string vibration detection process (to be described later in FIG. 12). In step S33, the CPU 41 performs a combining process (described later in FIG. 16). In step S34, the CPU 41 determines whether or not the string is emitting sound. If it is determined that the string is emitting sound, then the CPU 41 moves to step S32, and if it is determined that the string is not emitting sound, the CPU 41 moves to step S31.

<String-Press Position Detection Process>

Figure 9:
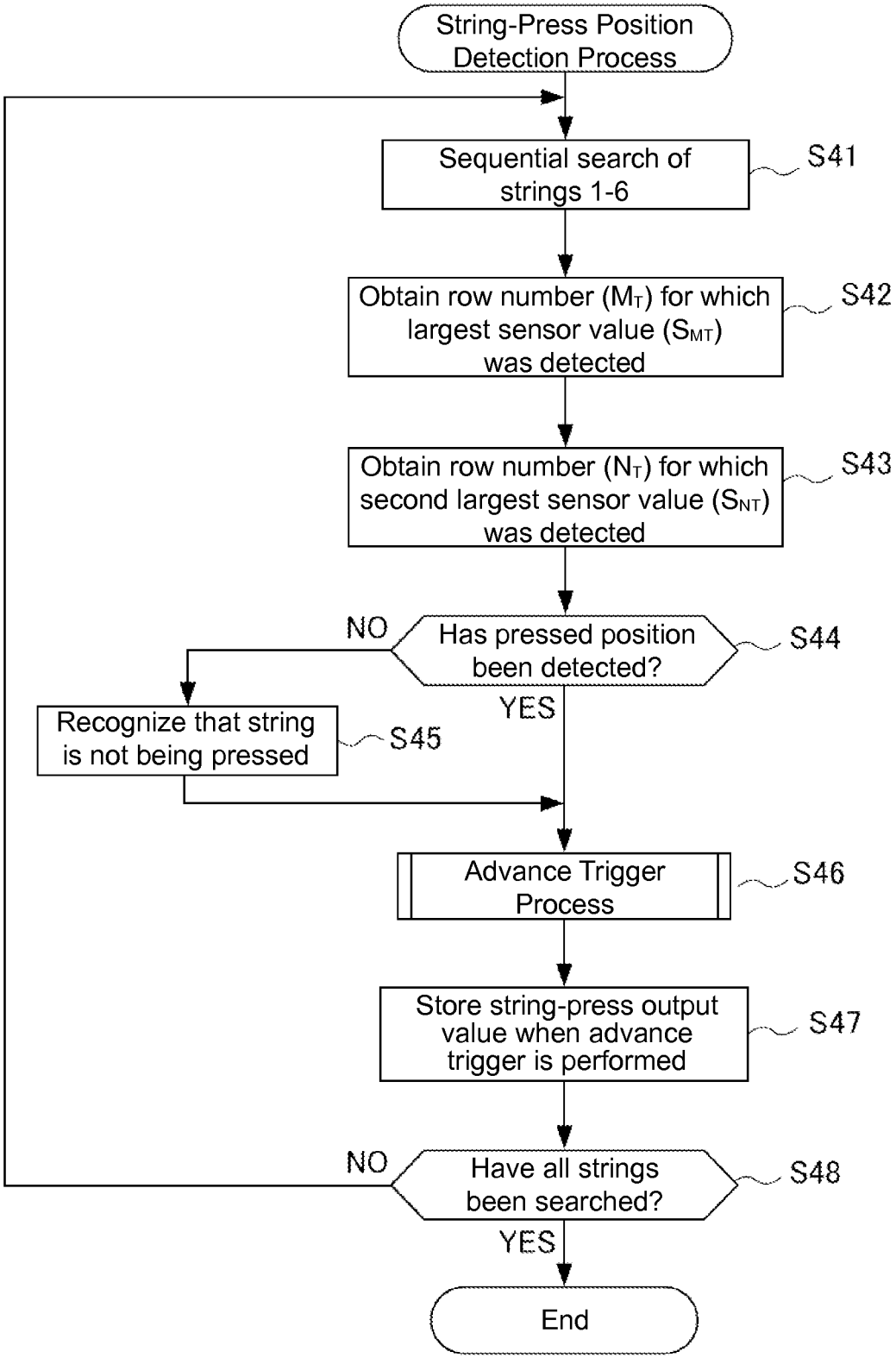
FIG. 9 is a flow chart showing a string-press position detection process executed in an electronic string instrument of the present embodiment.

FIG. 9 is a flow chart showing a string-press position detection process (step S31 in FIG. 8) executed in the electronic string instrument 1 of the present embodiment.

First, in step S41, the sensor values of respective electrostatic sensors 46 belonging to the first to sixth strings are sequentially searched. In step S42, the CPU 41 obtains a row number ($M_T$) for which the highest sensor value ($S_{MT}$) has been detected as the output value of the string-press sensor 44. In step S43, the CPU 41 obtains a row number ($N_T$) for which the next highest sensor value ($S_{NT}$) has been detected as the output value of the string-press sensor 4. In step S44, the CPU 41 determines whether or not a position where the string is pressed has been detected. If determined that a position where the string is pressed has been detected, the following is performed. The CPU 41 detects the interval corresponding to the fret belonging to the row number with the higher pitch (towards the bridge) among the obtained row numbers ($M_T$) and ($N_T$) as the position where the string has been pressed. If it is determined that a position where the string is pressed has been detected, the CPU 41 moves to step S46 and if it is determined that a position where the string is pressed has not been detected, the CPU 41 determines in step S45 that the string is not being pressed, or in other words, that the string is open. Then, the CPU 41 moves to step S46.

In step S46, the CPU 41 performs an advance trigger process (described later in FIG. 11). In step S47, the CPU 41 stores an output value of the string-press sensor 44 in the RAM 43 when the advance trigger process is performed. Here, the output value of the string-press sensor 44 when the advance trigger process is performed is stored as Snm for each position where the string is pressed. Here, n is the string number and m is the fret number.

In step S48, the CPU 41 determines whether or not all strings have been searched. If it is determined that not all strings have been searched, then the CPU 41 returns to step S41, and if it is determined that all strings have been searched, then the CPU 41 ends the string-press position detection process.

<Advance Trigger Process>

Figure 10:
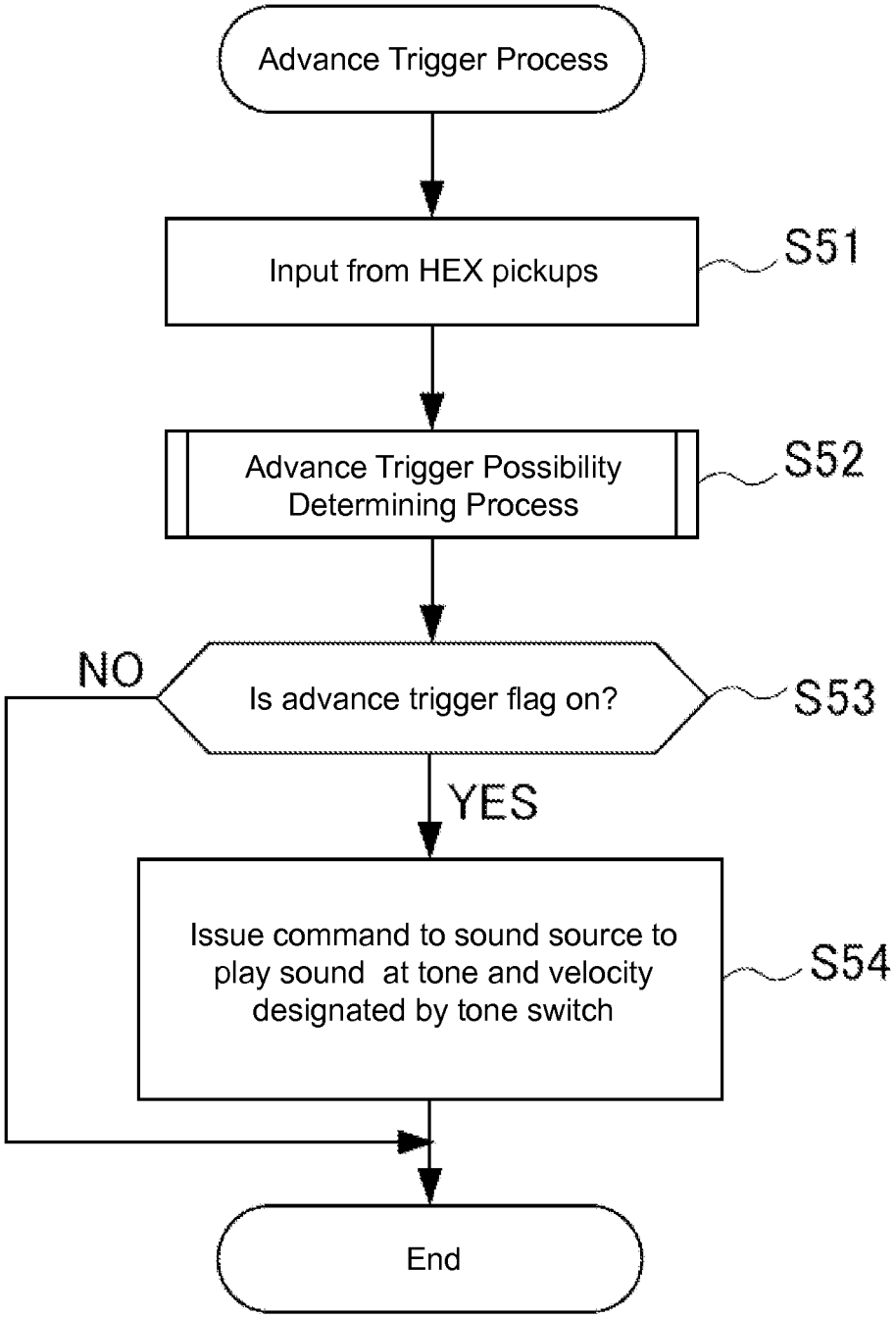
FIG. 10 is a flow chart showing an advance trigger process executed in an electronic string instrument of the present embodiment.

FIG. 10 is a flow chart showing an advance trigger process (step S44 in FIG. 9) executed in the electronic string instrument 1 of the present embodiment. Here, an advance trigger is a trigger to play a note when it is detected that the performer has pressed a string, but before the performer strikes the string.

First, in step S51, the CPU 41 receives output from the hexaphonic pickups 12 and obtains the vibration level of each of the strings. In step S52, the CPU 41 performs an advance trigger possibility determining process (described later in FIG. 11). In step S53, it is determined whether or not an advance trigger is possible, or in other words, whether or not the advance trigger flag is on. The advance trigger flag is turned on in step S62 for the advance trigger possibility determining process to be described later. If the advance trigger flag is on, the CPU 41 moves to step S54, and if the advance trigger flag is off, the CPU 41 ends the advance trigger process.

In step S54, the CPU 41 sends a signal as a command for the sound source 45 to play a sound based on the tone selected by the tone switch and the velocity determined in step S63 in the advance trigger possibility determining process. After step S54 is completed, the CPU 41 ends the advance trigger process.

<Advance Trigger Possibility Determining Process>

Figure 11:
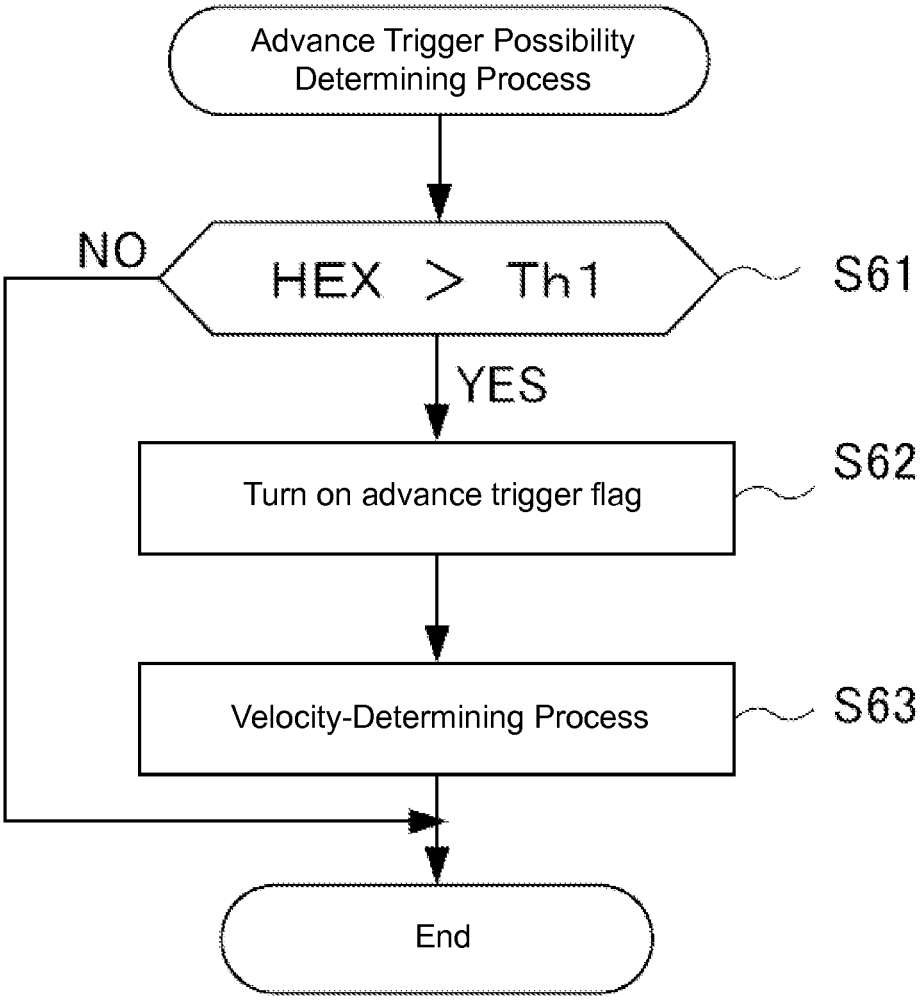
FIG. 11 is a flow chart showing an advance trigger possibility determining process, the process being executed in an electronic string instrument of the present embodiment.

FIG. 11 is a flow chart showing an advance trigger possibility determining process (step S52 in FIG. 10) executed in the electronic string instrument 1 of the present embodiment.

First, in step S61, the CPU 41 determines whether or not the vibration level of each of the strings based on the output from the hexaphonic pickups 12 received during step S51 in FIG. 10 is greater than a prescribed threshold (Th1). If the answer is YES, then the CPU 41 moves to step S62, and if the answer is NO, then the CPU 41 ends the advance trigger possibility determining process.

In step S62, the CPU 41 turns on the advance trigger flag in order to make possible the advance trigger. In step S63, the CPU 41 performs a velocity-determining process.

Specifically, in the velocity-determining process, the following processes are executed. The CPU 41 detects the acceleration of change in vibration level based on sampling data from three vibration levels before the vibration level based on the output from the hexaphonic pickups exceeds Th1 (hereinafter referred to as the "Th1 point"). Specifically, a first velocity of change in vibration level is calculated based on sampling data at one point before the Th1 point and two points before the Th1 point. In addition, a second velocity of change in vibration level is calculated based on sampling data at two points before the Th1 point and three points before the Th1 point. The acceleration of change in vibration level is detected based on the first velocity and the second velocity. In addition, the CPU 41 performs interpolation such that the velocity is within 0 to 127 during the acceleration dynamics obtained in an experiment.

Specifically, if the velocity is "VEL," the detected acceleration is "K," the acceleration dynamics obtained in an experiment is "D," and a correction value is "H," then the velocity is determined by Formula (2) below.

$$VEL=(K/D)\times 128\times H \quad (2)$$

Data from a map (not shown) indicating the relation between the acceleration K and the correction value H is stored in the ROM 42 for the pitch of each string. When observing the waveform of a pitch of a string, there are specific characteristics of change in waveform immediately after a plectrum has hit the string. Thus, data of these characteristics in a map is stored in the ROM 42 in advance for the pitch of each string, and therefore, a correction value H based on the detected acceleration K is obtained. After step S63 is completed, the CPU 41 ends the advance trigger possibility determining process.

<String Vibration Detection Process>

Figure 12:
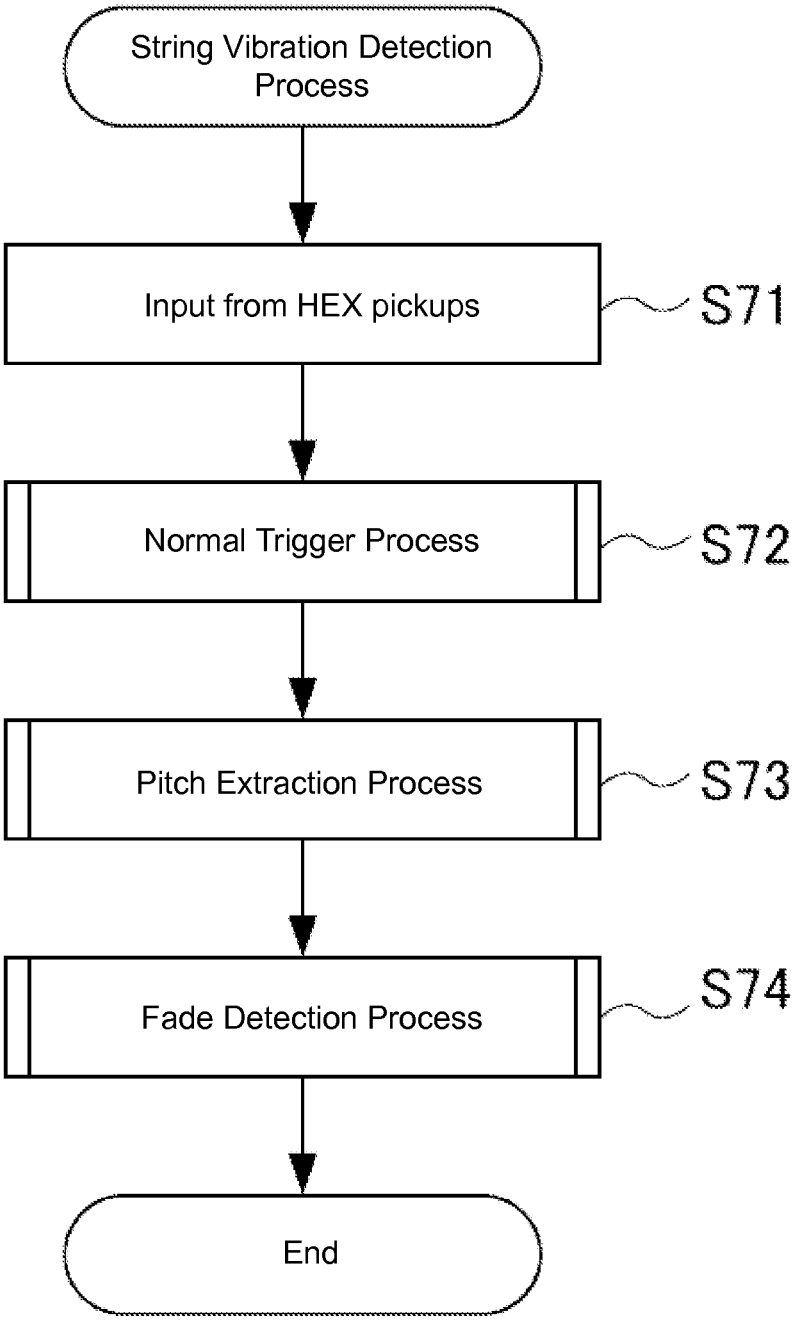
FIG. 12 is a flow chart showing a string vibration detection process executed in an electronic string instrument of the present embodiment.

FIG. 12 is a flow chart showing a string vibration detection process (step S32 in FIG. 8) executed in the electronic string instrument 1 of the present embodiment.

First, in step S71, the CPU 41 receives output from the hexaphonic pickups 12 and obtains the vibration level of each of the strings. In step S72, the CPU 41 performs a normal trigger process (described later in FIG. 13). In step S73, the CPU 41 performs a pitch extraction process (described later in FIG. 14). In step S74, the CPU 41 performs a fade detection process (to be described later in FIG. 15). After step S74 is completed, the CPU 41 ends the string vibration detection process.

<Normal Trigger Process>

Figure 13:
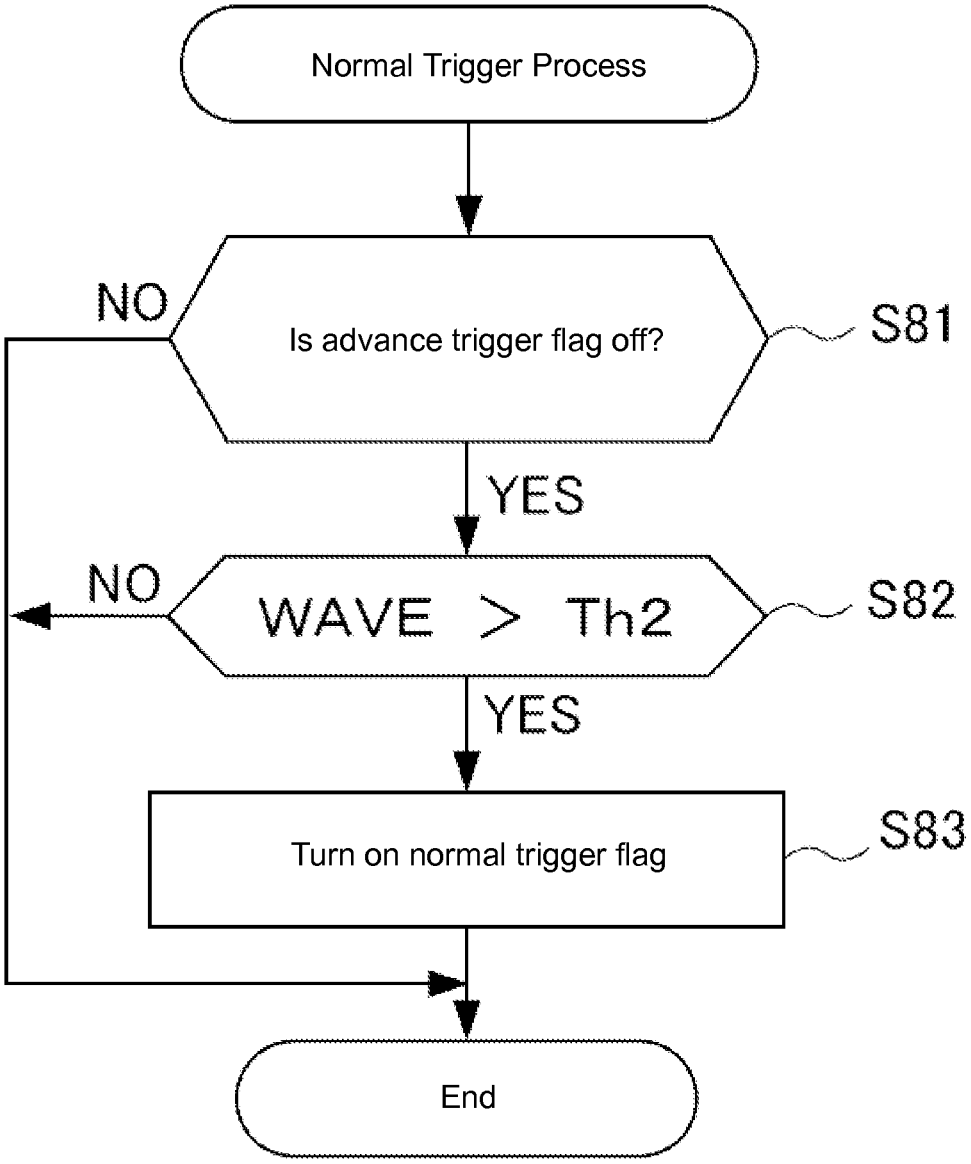
FIG. 13 is a flow chart showing a normal trigger process executed in an electronic string instrument of the present embodiment.

FIG. 13 is a flow chart showing a normal trigger process (step S72 in FIG. 12) executed in the electronic string instrument 1 of the present embodiment. A normal trigger is a trigger for playing a sound when it is determined that the performer has struck a string.

First, in step S81, the CPU 41 determines whether or not advance trigger is possible. That is, the CPU 41 determines whether or not the advance trigger flag is off. If it is determined that advance trigger is not possible, the CPU 41 moves to step S82. If it is determined that advance trigger is possible, the CPU 41 ends the normal trigger process. In step S82, the CPU 41 determines whether or not the vibration level of each of the strings based on the output from the hexaphonic pickups 12 received during step S71 in FIG. 12 is greater than a prescribed threshold (Th2). If the answer is YES, then the CPU 41 moves to step S83, and if the answer is NO, then the CPU 41 ends the normal trigger process. In step S83, the CPU 41 turns on the normal trigger flag in order to make possible the normal trigger. After step S83 is completed, the CPU 41 ends the normal trigger process.

<Pitch Extraction Process>

Figure 14:
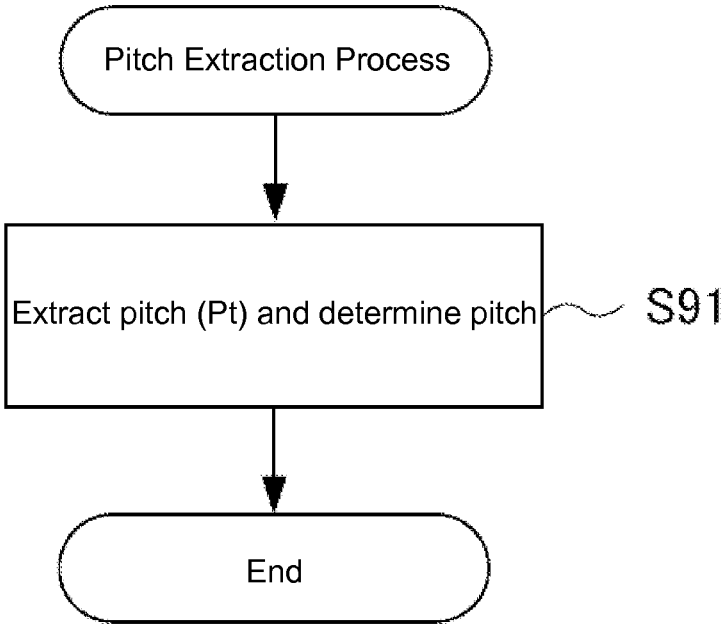
FIG. 14 is a flow chart showing a pitch extraction process executed in an electronic string instrument of the present embodiment.

FIG. 14 is a flow chart showing a pitch extraction process (step S73 in FIG. 12) executed in the electronic string instrument 1 of the present embodiment.

In step S91, the CPU 41 extracts a pitch to determine the pitch.

<Fade Detection Process>

Figure 15:
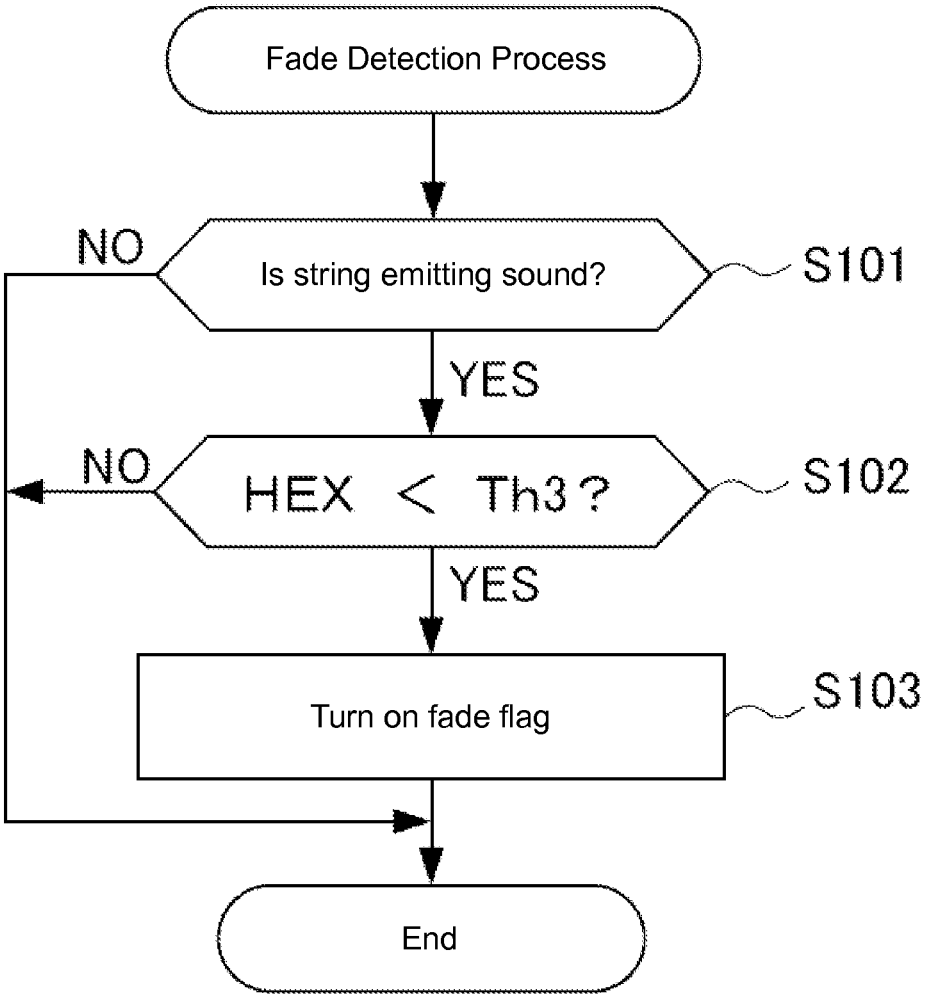
FIG. 15 is a flow chart showing a fade detection process executed in an electronic string instrument of the present embodiment.

FIG. 15 is a flow chart showing a fade detection process (step S74 in FIG. 12) executed in the electronic string instrument 1 of the present embodiment.

First, in step S101, the CPU 41 determines whether or not a string is emitting sound. If the answer is YES, then the CPU 41 moves to step S102, and if the answer is NO, then the CPU 41 ends the fade detection process. In step S102, the CPU 41 determines whether or not the vibration level of each string based on output from the hexaphonic pickups 12 received during step S71 of FIG. 12 is less than a prescribed threshold (Th3). If the answer is YES, then the CPU 41 moves to step S103, and if the answer is NO, then the CPU 41 ends the fade detection process. In step S103, the CPU 41 turns on a fade flag. After step S103 is completed, the CPU 41 ends the fade detection process.

<Combining Process>

Figure 16:
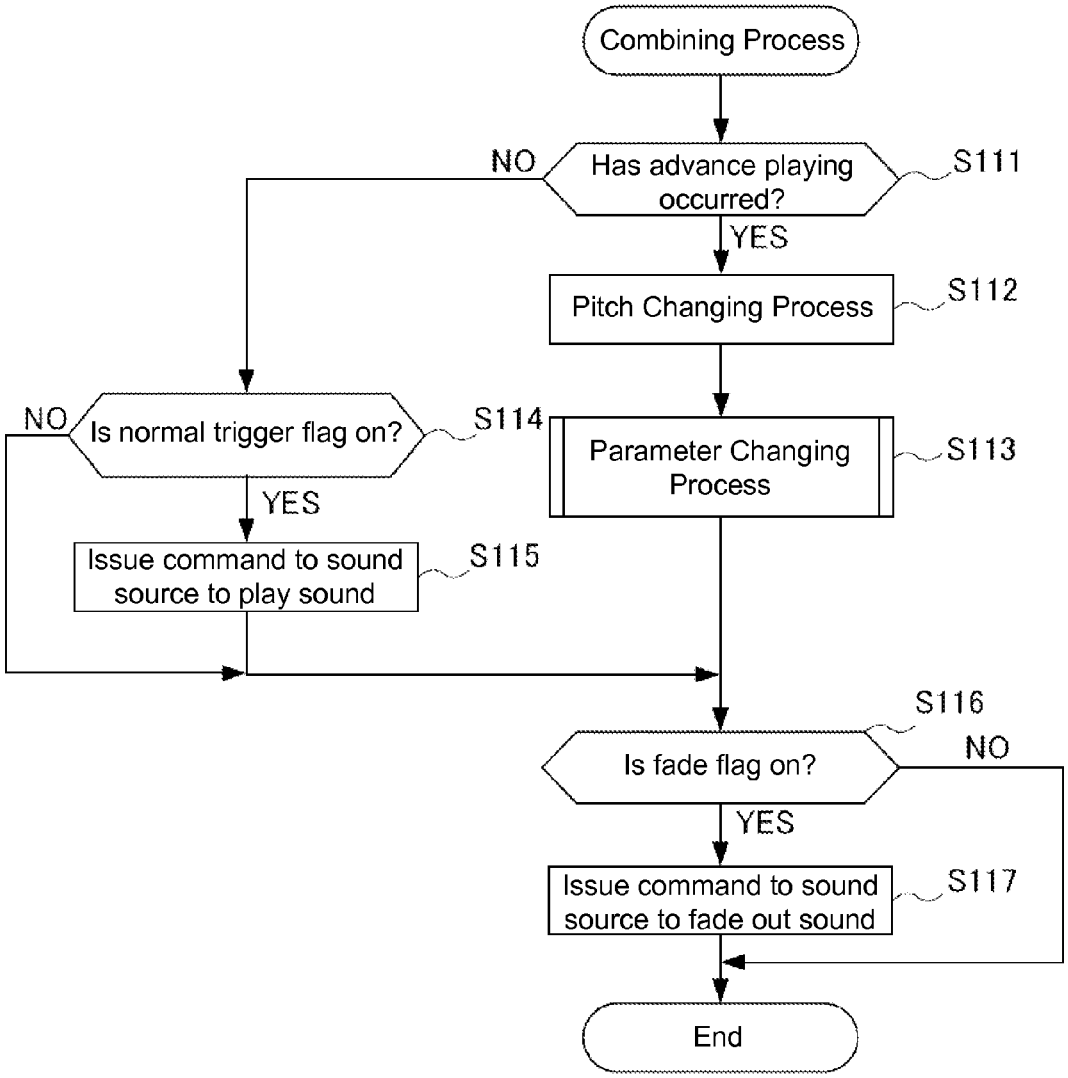
FIG. 16 is a flow chart showing a combining process executed in an electronic string instrument of the present embodiment.

FIG. 16 is a flow chart showing a combining process (step S33 in FIG. 8) executed in the electronic string instrument 1 of the present embodiment. In the combining process, the result of the string-press position detection process (step S31 in FIG. 8) and the result of the string vibration process (step S32 in FIG. 8) are combined.

First, in step S111, the CPU 41 determines whether or not advance playing has occurred. In other words, in the advance trigger process (refer to FIG. 10), it is determined whether or not a play command has been sent to the sound source 45. If, in the advance trigger process, it is determined that a playing command has been sent to the sound source 45, then the CPU 41 moves to step S112. In step S112, a pitch changing process is performed. In step S113, the CPU 41 executes the parameter changing process (described later in FIG. 17) and then moves to step S116.

On the other hand, if, in the advance trigger process in step S111, it is determined that no play command has been sent to the sound source 45, the CPU 41 moves to step S114. In step S114, the CPU 41 determines whether or not the normal trigger flag is on. If the normal trigger flag is on, the CPU 41 sends a play command signal to the sound source 45 in step S115, and moves to step S116. If the normal trigger flag is off in step S114, the CPU 41 moves to step S116.

In step S116, the CPU 41 determines whether or not the fade flag is on. If the fade flag is on, the CPU 41 sends a fade command signal to the sound source 45 in step S117. If the fade flag is off, the CPU 41 ends the combining process. After step S117 is completed, the CPU 41 ends the combining process.

<Parameter Changing Process>

Figure 17:
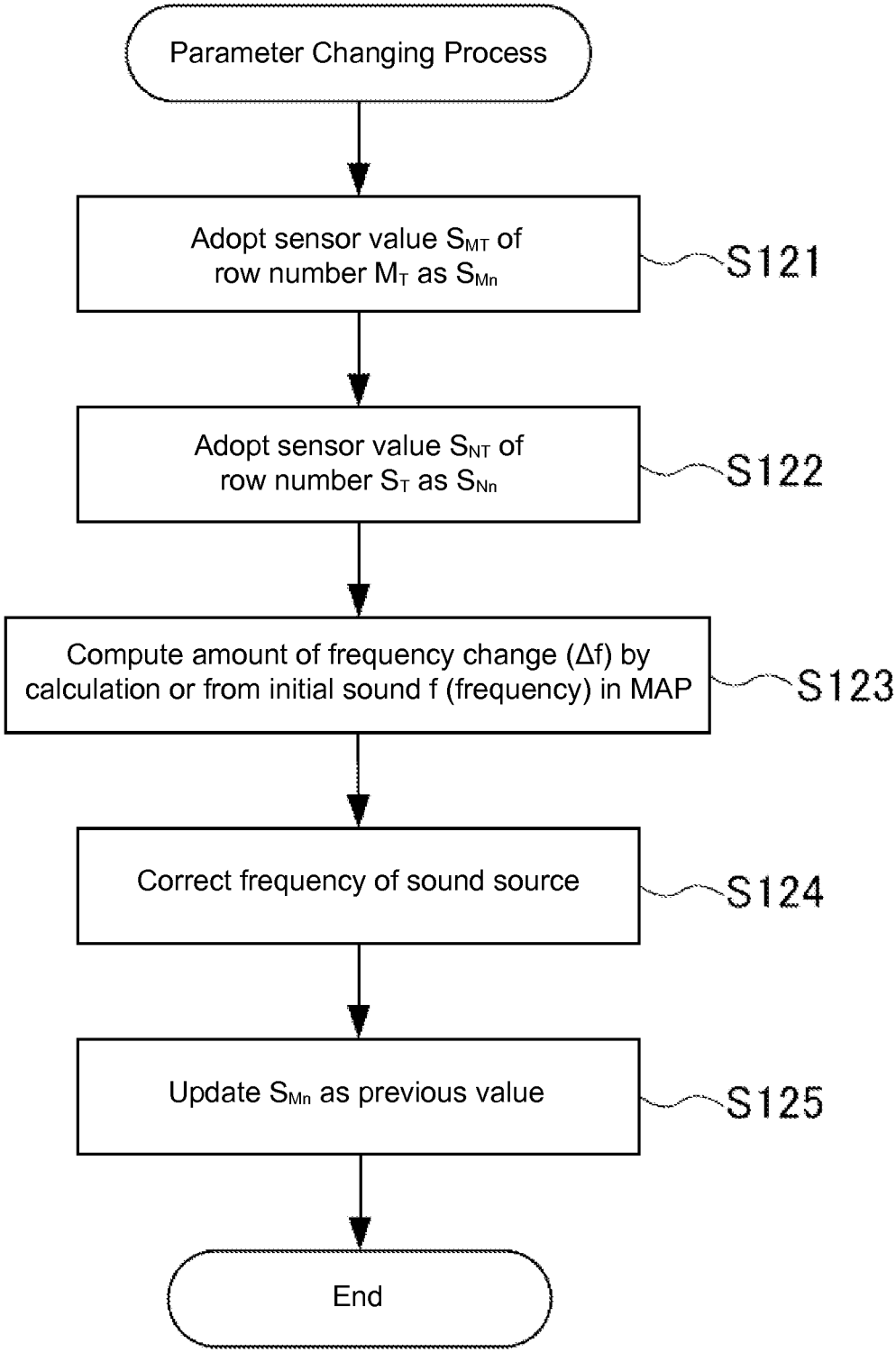
FIG. 17 is a flow chart showing a parameter changing process executed in an electronic string instrument of the present embodiment.

FIG. 17 is a flow chart showing a parameter changing process (step S112 in FIG. 16) executed in the electronic string instrument 1 of the present embodiment.

In step S121, the CPU 41 adopts the maximum sensor value ($S_{MT}$) of the electrostatic pad 26 ($M_T$) as $S_{Mn}$. In step S122, the CPU 41 adopts the next greatest sensor value ($S_{NT}$) of the electrostatic pad 26 ($N_T$) as $S_{Nn}$. In step S123, the CPU 41 calculates a frequency change (Δf) from an initial sound f (frequency). The frequency change (Δf) is calculated by Formula (1) below or from a map (refer to FIG. 18).

$$\Delta f = \pm f(S_{Mn} - S_{MT})/(S_{MT} + S_{NT}) \quad (1)$$

In other words, as the value of $(S_{Mn}-S_{MT})/(S_{MT}+S_{NT})$ increases, the absolute value of Δf increases.

Thus, the frequency change (Δf) can also be calculating using the map.

Figure 18:
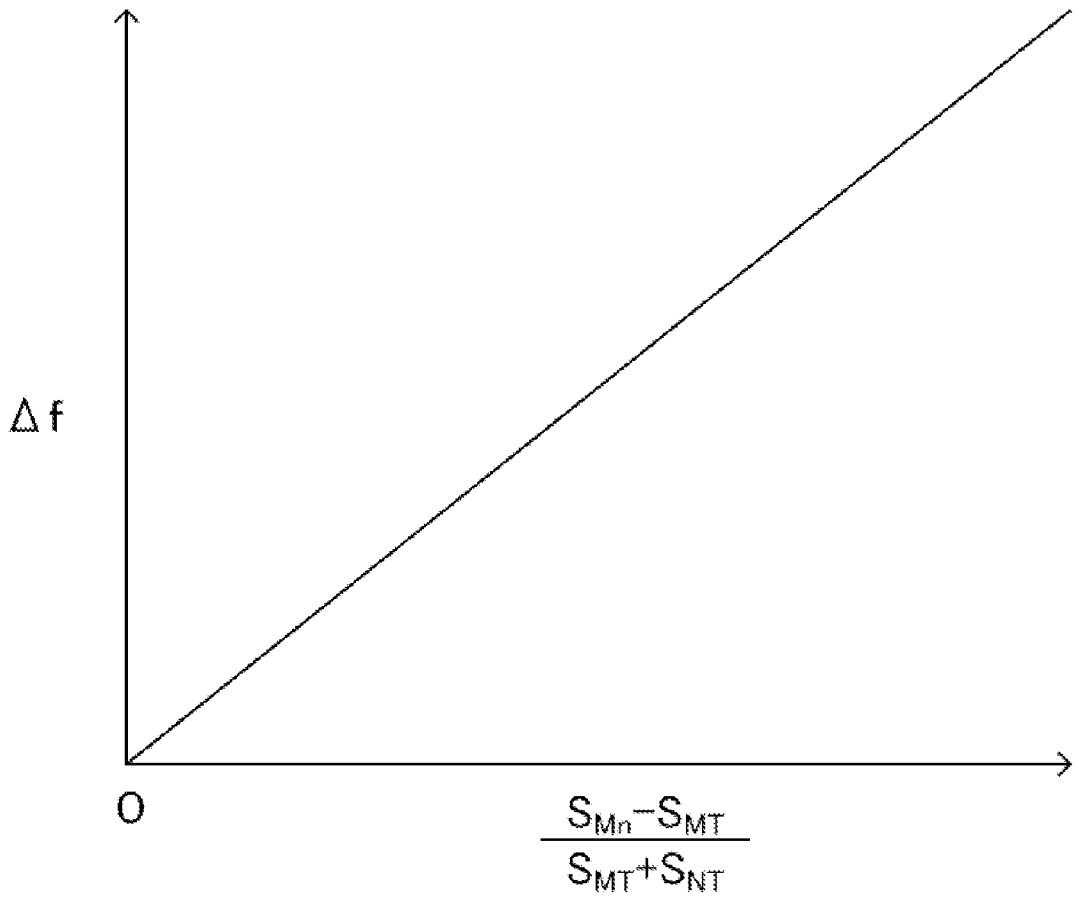
FIG. 18 shows a map for calculating the amount of change in frequency from when the string is initially played.

FIG. 18 shows a map for calculating the amount of change in frequency from when the string is initially played. The vertical axis shows "Δf," which is the frequency change, and the horizontal axis shows a value calculated from $(S_{Mn}-S_{MT})/(S_{MT}+S_{NT})$.

In step S124, the CPU 41 corrects the frequency of the sound source 45. In step S125, the CPU 41 designates the value of $S_{Mn}$ stored in the RAM 43 as the previous value. In the parameter changing process, an interval corresponding to the inter-fret space having the electrostatic pad with the largest detected sensor value when the note is initially played is played. Then, based on the detected sensor levels of two or more electrostatic pads, the frequency change (Δf) is determined based on calculation or the map, correction is performed, and the pitch reflects this correction. As a result, in the electronic string instrument 1, it is possible to reliably set the interval even if the string is pressed at a rough position, for example, and it is possible to have changes in the string-press state (changes in finger motion, for example) be reflected in vibrato, tone, and subtle changes in pitch, and it is possible to have similar performance to that of an actual string instrument. Because it is possible to attain a similar performance to that of an actual string instrument, this results in no stress to the performer or the like.

String-Press Position Detection Process

Modification Example

Figure 19:
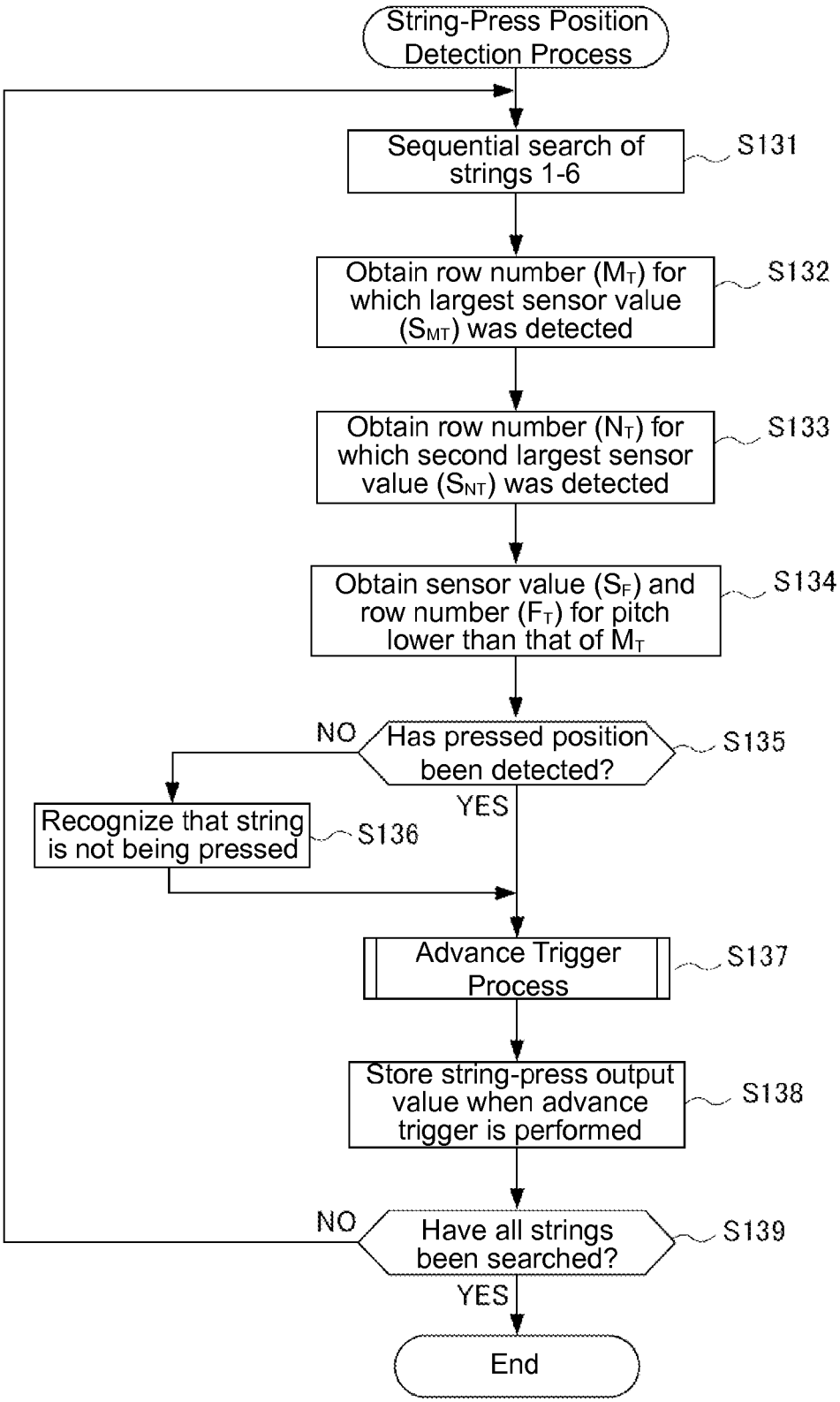
FIG. 19 is a flow chart showing a modification example of a string-press position detection process executed in an electronic string instrument of the present embodiment.

FIG. 19 is a flow chart showing a modification example of a string-press position detection process (step S31 in FIG. 8) executed in the electronic string instrument 1 of the present embodiment.

The processes of steps S131 to S133 and S135 to S139 are similar to the steps S41 to S48 of FIG. 9 mentioned above.

In step S134, the CPU 41 obtains a row number ($F_T$) corresponding to a sensor value ($S_F$) lower than the pitch of $M_T$.

Parameter Changing Process

Modification Example

Figure 20:
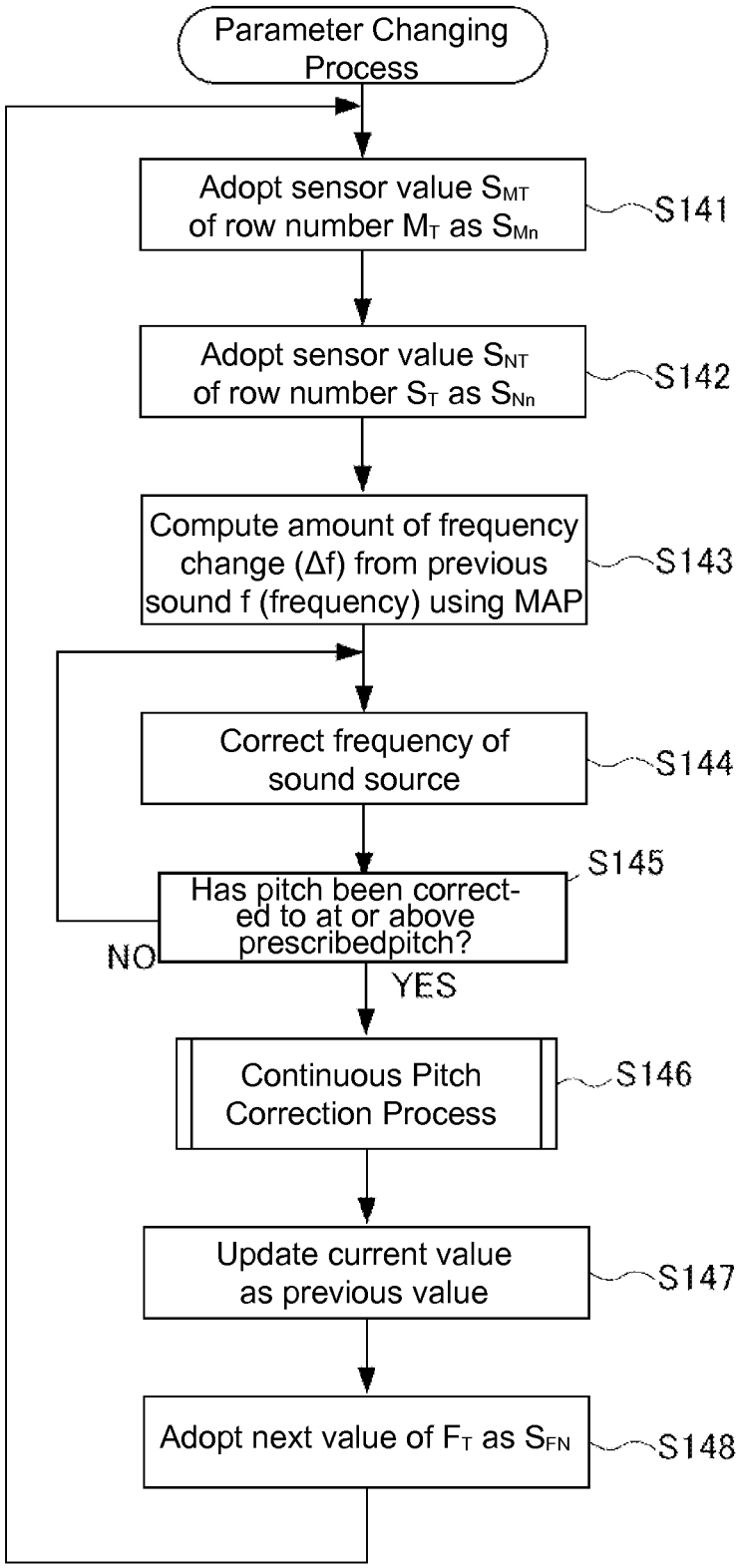
FIG. 20 is a flow chart showing a modification example of a parameter changing process executed in an electronic string instrument of the present embodiment.

FIG. 20 is a flow chart showing a modification example of a parameter changing process (step S113 in FIG. 16) executed in the electronic string instrument 1 of the present embodiment.

Steps S141, S142, and S144 are similar to the steps S121, S122, and S124 in FIG. 17 mentioned above.

In step S143, the CPU 41 calculates the frequency change (Δf) from the previous sound f (frequency) by the map.

Figure 21B:
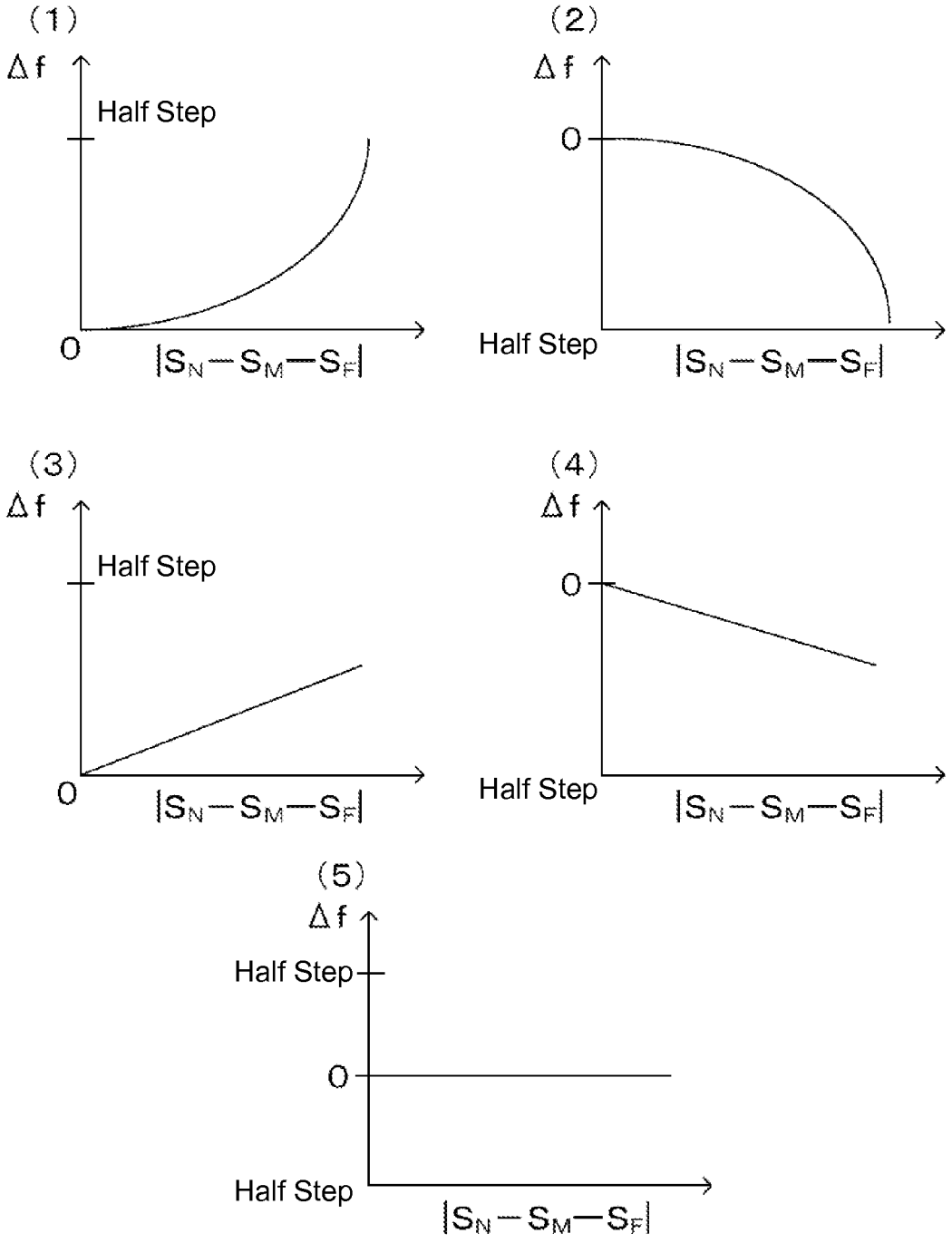

FIGS. 21A and 21B are for calculating the frequency change from the previous sound; FIG. 21A shows a matrix for determining the type of finger movement, and FIG. 21B shows maps for calculating the frequency change.

The calculation of the frequency change (Δf) is determined by selecting the type of finger movement from the matrix (refer to FIG. 21A, and finding the map corresponding to the selected type (refer to FIG. 21B).

As shown in the matrix in FIG. 21A, in the present embodiment, the finger movements are categorized into types (1) to (5). Specifically, there are the following patterns: type (1) (pitch: shifted upward) selected when $S_F$ increases, $S_M$ has no change, and $S_N$ increases; type (2) (pitch: shifted downward) selected when $S_F$ increases, $S_M$ has no change, and $S_N$ decreases; type (3) (number of fingers pressing string increases) selected when $S_F$ increases, $S_M$ shows no change and then increases, and $S_N$ increases; type 4 (pressure on string decreases) selected when $S_F$, $S_M$, and $S_N$ decrease; type (5) (other pattern) selected when $S_F$, $S_M$, and $S_N$ experience no change; and the like.

In accordance with the selected pattern, the frequency (Δf) is calculated based on the absolute value of the difference of $S_F$, $S_M$, and $S_N$ ($|S_F-S_M-S_N|$) using the maps of FIG. 21B.

In step S145, the CPU 41 determines whether or not a pitch has been corrected to greater than or equal to a prescribed pitch. If it is determined that the pitch has been corrected to greater than or equal to the prescribed pitch, the CPU 41 moves to step S144, and if it is determined that the pitch has not been corrected to greater than or equal to the prescribed pitch, the CPU 41 moves to step S146.

Figure 22:
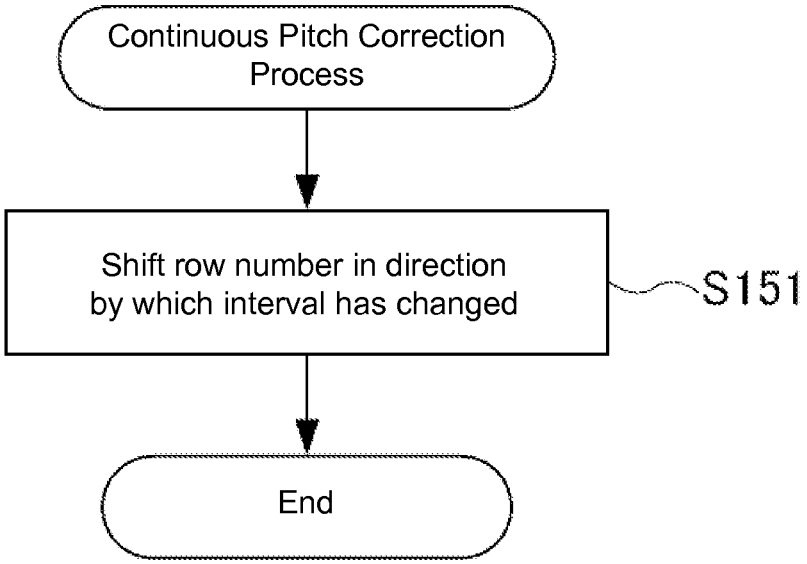
FIG. 22 is a flow chart showing a continuous pitch correction process executed in an electronic string instrument of the present embodiment.

In step S146, the CPU 41 executes a continuous pitch correction process (refer to FIG. 22). As a result, a pitch change is done continuously even if a finger continues to press the string. In step S147, the CPU 41 updates the current value as the previous value. In step S148, the CPU 41 adopts the next value of $F_T$ as $S_{FN}$. Then, the CPU 41 moves to step S141.

<Continuous Pitch Correction Process>

FIG. 22 is a flow chart showing a continuous pitch correction process (step S146 in FIG. 20) executed in the electronic string instrument 1 of the present embodiment.

In step S151, the CPU 41 shifts the row number to a direction in which the interval has changed. In other words, if the position of the electrostatic pad 26 with the maximum detected sensor value changes, then based on the row number of the electrostatic pad 26 prior to this change, the row number is changed to that of the interval (initial pitch) corresponding to the row number of the electrostatic pad 26 after this change. Specifically, if the pitch has shifted higher, then $S_{FT}$, $S_{MT}$, $S_{NT}$, $S_{Fn}$, $S_{Mn}$, and $S_{Nn}$ are all shifted to a higher pitch. After step S141 is completed, the CPU 41 ends the continuous pitch correction process.

Configurations and processes of the electronic string instrument 1 of the present embodiment have been described above.

In the present embodiment, the electrostatic pads 26 detect operations on the fingerboard 21 at a prescribed frequency. The hexaphonic pickups 12 detect a play command that is issued for a sound to be played.

The CPU 41 stores the detected operation state in the RAM 43 every time the operation state is detected, and, in response to the detected play command operation, issues a command to a connected sound source to play a note of a pitch that is to be played based on the operation state stored in the RAM 43. After the command to play a note is issued to the connected sound source, the note played in the connected sound source 45 is controlled based on the detected operation state and the operation state stored in the RAM 43 every time the operation state is detected.

Thus, it is possible to have the string-press state be reflected in subtle changes in tone and pitch.

Also, in the present embodiment, in the electronic string instrument 1, a plurality of strings 22 are extended over the fingerboard 21. The electrostatic pads 26 detect the string-press state in which any of the plurality of strings 22 are pressed on the fingerboard 21 as an operation state. The hexaphonic pickups 12 detect whether or not any of the plurality of extended strings 22 has been struck as a play command operation state.

Thus, it is possible to have the string-press state be reflected in subtle changes in tone and pitch.

In the present embodiment, in the electronic string instrument 1, a plurality of frets 23 are provided on the fingerboard 21. The electrostatic pads 26 are constituted of a plurality of sensors that are provided in positions corresponding to the respective plurality of frets 23, that detect a proximity of the pressed strings to the sensors, and that output a signal corresponding to the detected proximity.

The CPU 41 searches, as the string-press state, the sensor and the output signal thereof for the electrostatic pad 26 among the plurality of electrostatic pads 26 with the closest proximity to a fret.

Thus, it is possible to have the string-press state be reflected in subtle changes in tone and pitch.

Also, in the present embodiment, the CPU 41 controls at least one of the pitch, tone, and volume of a note played in the connected sound source 45.

Thus, it is possible to have the string-press state be reflected in subtle changes in tone and pitch.

Also, in the present embodiment, the CPU 41 extracts the vibration pitch of the string vibration signal generated when a string that has been struck is detected, and based on the extracted pitch, the CPU 41 controls the pitch of the note played by the connected sound source 45.

Thus, it is possible to have the string-press state be reflected in subtle changes in tone and pitch.

Also, in the present embodiment, the CPU 41 reads in the output signal of the electrostatic pad 26 with a string at the closest proximity thereto as the string-press state stored in the RAM 43, and controls the pitch of the note played based on the difference between the read-in output signal and the output signal of the electrostatic pad 26 detected as the string-press state after a play command has been issued.

Thus, it is possible to have the string-press state be reflected in subtle changes in tone and pitch.

Also, in the present embodiment, the RAM 43 has an area to store a previously detected string-press state, and a string-press state detected previously thereto.

The CPU 41 updates the contents of what is stored in the prescribed area of the RAM 43 every time a current string-press state is detected by the electrostatic pad 26, and controls the pitch of the note played based on the previously detected string-press state, the string-press state detected previously thereto, and the currently detected string-press state that are stored.

Thus, it is possible to have the string-press state be reflected in subtle changes in tone and pitch.

The present invention is not limited to the embodiment above, and includes changes, modifications, or the like made within a scope by which it is possible to attain the object of the present invention.

The embodiment above is configured so as to have two electrostatic pads 26 between the frets, but the present invention is not limited thereto, and may be configured so as to detect a string-press state with more than two electrostatic pads. By increasing the number of electrostatic pads, the more subtle changes in finger position can be detected.

Also, in the embodiment above, the music playing device to which the present invention is applied has been described with the electronic string instrument 1 having the headstock 30, the bridge 16, and the strings 22 attached thereto as an example, but the present invention is not limited thereto. The music playing device of the present invention may be a fretless electronic instrument in which a chromatic interval corresponding to the region on the fingerboard that is pressed can be played with a seamless interval change in accordance with finger movement. The music playing device can be an electronic instrument without strings or a bowed string instrument in which a bow sensor is attached to the right hand, for example.

The series of processes described above can be accomplished by hardware or software.

If the series of processes are accomplished by software, the programs constituting the software are installed on a computer or the like through a network or a storage medium.

The computer may be installed in specialized hardware. The computer may be a computer that can execute various functions by installing various programs, or it may be a general personal computer, for example.

The storage medium including such a program is distributed separately from a main device body in order to provide the user with programs, and is provided to the user pre-installed in the main device body. The storage medium is a magnetic disk (including floppy disks), an optical disc, a magneto-optical disc, or the like, for example. The optical disc is a CD-ROM (compact disc-read only memory), a DVD (digital versatile disc), or the like, for example. The magneto-optical disc is an MD (MiniDisc) or the like. The storage medium provided to the user pre-installed in the main storage body is a hard disk or the like included in the RAM 43 of FIG. 2 in which programs is stored, for example.

In the present specification, the step of storing the programs in the storage medium includes not only time-oriented processes that take place in that order but also parallelly or individually executed processes.

An embodiment of the present invention has been described above, but the embodiment is merely an example and does not limit the technical scope of the present invention. Various other embodiments can be made of the present invention, and it is possible to make various modifications such as omissions or replacements of elements within a scope that does not depart from the gist of the present invention. Embodiments and modifications thereof are included in the scope and gist of the invention disclosed in the present specification and the like, and are included in the invention disclosed in the claims and an equivalent thereof.

It will be apparent to those skilled in the art that various modifications and variations can be made in the present invention without departing from the spirit or scope of the invention. Thus, it is intended that the present invention cover modifications and variations that come within the scope of the appended claims and their equivalents. In particular, it is explicitly contemplated that any part or whole of any two or more of the embodiments and their modifications described above can be combined and regarded within the scope of the present invention.

What is claimed is:

1. A music playing device comprising:

a fingerboard over which a plurality of strings extend;

a plurality of frets provided on the fingerboard;

a plurality of sensors provided in the fingerboard in positions corresponding to the respective plurality of frets along the respective plurality of strings thereabove, each of the sensors detecting, as a string-press state, a proximity of the string thereabove to the sensor so as to detect a pressing degree of the string on the fingerboard by a user and outputting a signal indicating said detected proximity;

a search unit that searches for a sensor among the plurality of sensors that is at a closest proximity with the string thereabove at a prescribed frequency;

a memory control unit that stores the proximity of the sensor that is found by the search unit to be at the closest proximity in a memory as a current operation state and that designates as an immediately previous operation state the proximity of the sensor that was found by the search unit to be at the closest proximity in the memory immediately prior to the current operation state being stored, every time the search unit searches for and finds the sensor that is at the closest proximity with the string;

a play command operation detection unit that detects, as a play command operation, an action of any of the plurality of strings being struck by the user;

a pitch determination unit that determines a pitch of a musical note to be played in response to the play command operation being detected and based on the current operation state stored in the memory;

a play command unit that issues a command to a sound source to play the musical note of said determined pitch; and a first musical note control unit that, after the command to play the musical note is issued to the sound source, modulates the musical note played in the sound source based on the current operation state and the immediately previous operation state stored in the memory.

2. The music playing device according to claim 1, wherein the first musical note control unit reads in the signal indicating the proximity from the sensor that is at the closest proximity with the string stored in the memory, and controls a pitch of the musical note being played based on a difference between the read-in signal and the signal from the same sensor indicating the proximity to the string thereabove, that is detected after the play command has been issued.

3. The music playing device according to claim 1, wherein the first musical note control unit controls at least one of a pitch, tone, and volume of the musical note played in the sound source that is connected.

4. The music playing device according to claim 1, further comprising:

a pitch extraction unit that extracts a vibration pitch of a vibration signal generated by said struck string that has been detected; and a second music control unit that controls a pitch of the musical note played in the sound source based on the pitch extracted by the pitch extraction unit.

5. The music playing device according to claim 1, wherein the memory stores three consecutively detected string-press states: a current string-press state; an immediately previously detected string-press state; and a string-press state detected immediately prior to said immediately previously detected string-press state, wherein the memory control unit updates the consecutively detected string-press states stored in the memory every time the plurality of sensors newly detects a current string-press state, and wherein the first music control unit controls a pitch of the musical note that is played based on said three consecutively detected string-press states.

6. An electronic instrument, comprising:

the music playing device according to claim 1; and a sound source that generates a musical note in response to a command to play a sound from a music play command unit.

7. A music playing method performed by a music playing device that includes: a fingerboard over which a plurality of strings extend, a plurality of frets provided on the fingerboard, and a plurality of sensors that are provided in the fingerboard in positions corresponding to the respective plurality of frets along the respective plurality of strings thereabove, each of the sensors detecting, as a string-press state, a proximity of the string thereabove to the sensor so as to detect a pressing degree of the string on the fingerboard by a user, and outputting a signal indicating said detected proximity, the method comprising:

searching a sensor among the plurality of sensors that is at a closest proximity with the string thereabove at a prescribed frequency;

storing the detected proximity of the sensor that is found to be at the closet proximity in a memory as a current operation state and designating as an immediately previous operation state the proximity of the sensor that was found to be at the closest proximity in the memory immediately prior to the current operation state being stored, ever time the sensor that is at the closest proximity is searched;

detecting, as a play command operation, an action of any of the plurality of strings being struck by the user;

determining a pitch of a musical note to be played in response to the play command operation being detected and based on the current operation state stored in the memory;

issuing a command to a sound source to play the musical note of the determined pitch; and modulating, after the command to play the musical note is issued to the sound source, the musical note played in the sound source based on the current operation state and the immediately previous operation state stored in the memory.

8. A non-transitory storage medium that can be read by a computer provided in a music playing device that includes: a fingerboard over which a plurality of strings extend, a plurality of frets provided on the fingerboard, and a plurality of sensors provided in the fingerboard in positions corresponding to the respective plurality of frets along the respective plurality of strings thereabove, each of the sensors detecting, as a string-press state, a proximity of the string thereabove to the sensor so as to detect a pressing degree of the string on the fingerboard by a user, and outputting a signal indicating said detected proximity, the non-transitory storage medium storing a computer program to be executed by the computer to cause the music playing device having the computer to perform the following steps:

searching a sensor among the plurality of sensors that is at a closest proximity with the string thereabove at a prescribed frequency;

storing the detected proximity of the sensor that is found to be at the closet proximity in a memory as a current operation state and designating as an immediately previous operation state the proximity of the sensor that was found to be at the closest proximity in the memory immediately prior to the current operation state being stored, ever time the sensor that is at the closest proximity is searched;

detecting, as a play command operation, an action of any of the plurality of strings being struck by the user;

determining a pitch of a musical note to be played in response to the play command operation being detected and based on the current operation state stored in the memory;

issuing a command to a sound source to play the musical note of the determined pitch; and modulating, after the command to play the musical note is issued to the sound source, the musical note played in the sound source based on the current operation state and the immediately previous operation state stored in the memory.

9. The electronic instrument according to claim 1, wherein, with respect to each of the strings, two or more of the plurality of sensors are provided for each fret in the fingerboard.

* * * * *